US007495648B2

(12) United States Patent
Kang et al.

(10) Patent No.: US 7,495,648 B2
(45) Date of Patent: Feb. 24, 2009

(54) LIQUID CRYSTAL DISPLAY DEVICE

(75) Inventors: Sin Ho Kang, Suwon-si (KR); Hong Sung Song, Kumi-si (KR); Jin Cheol Hong, Kumi-si (KR)

(73) Assignee: LG Display Co., Ltd., Seoul (KR)

( * ) Notice: Subject to any disclaimer, the term of this patent is extended or adjusted under 35 U.S.C. 154(b) by 833 days.

(21) Appl. No.: 10/964,779

(22) Filed: Oct. 15, 2004

(65) Prior Publication Data

US 2005/0128170 A1 Jun. 16, 2005

(30) Foreign Application Priority Data

Dec. 11, 2003 (KR) ..... 10-2003-0090301
Apr. 28, 2004 (KR) ..... 10-2004-0029611
Apr. 28, 2004 (KR) ..... 10-2004-0029612

(51) Int. Cl.
*G09G 3/36* (2006.01)

(52) U.S. Cl. ..... 345/100; 345/98

(58) Field of Classification Search ..... 345/55–100, 345/204–214

See application file for complete search history.

(56) References Cited

U.S. PATENT DOCUMENTS 7,071,928 B2 * 7/2006 Kwon et al. ..... 345/204
7,167,153 B2 * 1/2007 Kimura et al. ..... 345/100

FOREIGN PATENT DOCUMENTS

| | | |
|---|---|---|
| CN | 1180418 | 4/1998 |
| CN | 1405745 | 3/2003 |
| CN | 1412736 | 4/2003 |
| JP | 61-292127 | 12/1986 |
| JP | 64-084298 | 3/1989 |
| JP | 04-170515 | 6/1992 |
| JP | 06-043424 | 2/1994 |
| JP | 11-311763 | 11/1999 |
| JP | 2002-278492 | 9/2002 |
| JP | 2003-195836 | 7/2003 |

* cited by examiner

*Primary Examiner*—David L Lewis
(74) *Attorney, Agent, or Firm*—McKenna Long & Aldridge LLP

(57) ABSTRACT

A display having a data driving integrated circuit includes N number of output channels (where N is an integer) having at least two regions including a first output channel and an Nth output channel, a data output channel group including M data output channels (where M is an integer less than N), the M data output channels supplying pixel data to a corresponding number of the data lines in accordance with a desired resolution of the display, wherein (N-M) output channels are not supplied with pixel data, and the (N-M) output channels are located between the first output channel and the Nth output channel, and a channel selector selecting the M data output channels.

60 Claims, 18 Drawing Sheets

LIQUID CRYSTAL DISPLAY DEVICE

This application claims the benefit of Korean Patent Application No. P2003-90301, filed Dec. 11, 2003, and P2004-29611 and P2004-29612 filed on Apr. 28, 2004, which are hereby incorporated by reference for all purposes as if fully set forth herein.

BACKGROUND OF THE INVENTION

1. Field of the Invention

This invention relates to a liquid crystal display. More particularly, the invention relates to a liquid crystal display device that improves the working efficiency of a liquid crystal display device, as well as reduces manufacturing cost.

2. Description of the Related Art

Generally, a liquid crystal display (LCD) controls light transmittance of a liquid crystal using an electric field to display a picture.

To this end, as shown in FIG. 1, the LCD includes a liquid crystal display panel 2 having liquid crystal cells arranged in a matrix, a gate driver 6 for driving gate lines GL1 to GLn of the liquid crystal display panel 2, a data driver 4 for driving data lines DL1 to DLm of the liquid crystal display panel 2, and a timing controller 8 for controlling the gate driver 6 and the data driver 4.

The liquid crystal display panel 2 includes a thin film transistor TFT provided at each crossing of the gate lines GL1 to GLn and the data lines DL1 to DLm, and a liquid crystal cell 7 connected to the thin film transistor TFT. The thin film transistor TFT is turned on when supplied with a scanning signal, for example, a gate high voltage VGH from the gate line GL, to apply a pixel signal from the data line DL to the liquid crystal cell 7. Further, the thin film transistor TFT is turned off when supplied with a gate low voltage VGL from the gate line GL to keep a pixel signal charged in the liquid crystal cell 7.

The liquid crystal cell 7 can be equivalently represented as a liquid crystal capacitor. The liquid crystal cell 7 includes a pixel electrode connected with a common electrode and a thin film transistor with a liquid crystal therebetween. Further, the liquid crystal cell 7 includes a storage capacitor that maintains a signal level of the charged pixel signal until the next pixel signal is charged. The storage capacitor is provided between the pixel electrode and the pre-stage gate line. Such a liquid crystal cell 7 varies an alignment state of the liquid crystal having a dielectric anisotropy in accordance with a pixel signal charged through the thin film transistor TFT to control a light transmittance, thereby implementing gray scale levels.

The timing controller 8 generates gate control signals (i.e., gate start pulse (GSP), gate shift clock (GSC) and gate output enable (GOE)) and data control signals (i.e., source start pulse (SSP), source shift clock (SSC), source output enable (SOE) and polarity control (POL)) using synchronizing signals V and H supplied from a video card (not shown). The gate control signals (i.e., GSP, GSC and GOE) are applied to the gate driver 6 to control the gate driver 6, while the data control signals (i.e., SSP, SSC, SOE and POL) are applied to the data driver 4 to control the data driver 4. Further, the timing controller 8 aligns red (R), green (G) and blue (B) pixel data VD and applies the data to the data driver 4.

The gate driver 6 sequentially drives the gate lines GL1 to GLn. To this end, the gate driver 6 includes a plurality of gate integrated circuits (IC's) 10 as shown in FIG. 2A. The gate IC's 10 sequentially drive the gate lines GL1 to GLn connected thereto under control of the timing controller 8. Specifically, the gate IC's 10 sequentially apply a gate high voltage VGH to the gate lines GL1 to GLn in response to the gate control signals (i.e., GSP, GSC and GOE) from the timing controller 8.

The gate driver 6 shifts a gate start pulse GSP in response to a gate shift clock GSC to generate a shift pulse. Then, the gate driver 6 applies a gate high voltage VGH to the corresponding gate line GL every horizontal period in response to the shift pulse. The shift pulse is shifted line-by-line for each horizontal period, and any one of the gate IC's 10 applies the gate high voltage VGH to the corresponding gate line GL to correspond with the shift pulse. The gate IC's supply a gate low voltage, VGL, in a remaining interval when the gate high voltage, VGH, is not supplied to the gate lines GL1 to GLn.

The data driver 4 applies pixel signals for each line to the data lines DL1 to DLm for each horizontal period. The data driver 4 includes a plurality of data IC's 16 as shown in FIG. 2B. The data IC's 16 apply pixel signals to the data lines DL1 to DLm in response to data control signals (i.e., SSP, SSC, SOE and POL) from the timing controller 8. The data IC's 16 convert pixel data VD from the timing controller 8 analog pixel signals using a gamma voltage from a gamma voltage generator (not shown) to output them.

The data IC's 16 shift a source start pulse SSP in response to a source shift clock SSC to generate sampling signals. Then, the data IC's 16 sequentially latch the pixel data VD for a particular unit in response to the sampling signals. Thereafter, the data IC's 16 convert the latched pixel data VD for one line to analog pixel signals, and apply the signals to the data lines DL1 to DLm in an enable interval of a source output enable signal SOE. The data IC's 16 convert the pixel data VD to positive or negative pixel signals in response to a polarity control signal POL.

As shown in FIG. 3, each of the data IC's 16 includes a shift register part 34 for sequential applying sampling signals, a latch part 36 for sequentially latching the pixel data VD in response to the sampling signals to simultaneously output the signals, a digital to analog converter (DAC) 38 for converting the pixel data VD from the latch part 38 to pixel voltage signals, and an output buffer part 46 for buffering pixel voltage signals from the DAC 38 to output them. Further, the data IC 16 includes a signal controller 20 for interfacing various control signals (i.e., SSP, SSC, SOE, REV and POL, etc.) from the timing controller 8 and the pixel data VD, and a gamma voltage part 32 for supplying positive and negative gamma voltages required for the DAC 38.

The signal controller 20 controls various control signals (i.e., SSP, SSC, SOE, REV and POL, etc.) from the timing controller 8 and the pixel data VD in such a manner to be output to the corresponding elements.

The gamma voltage part 32 sub-divides a plurality of gamma reference voltages input from a gamma reference voltage generator (not shown) for each gray level to output them.

Shift registers included in the shift register part 34 sequentially shift a source start pulse SSP from the signal controller 20 in response to a source sampling clock signal SSC to output it as a sampling signal.

The latch part 36 sequentially samples the pixel data VD from the signal controller 20 for a certain unit in response to the sampling signals from the shift register part 34 to latch them. The latch part 36 is comprised of i latches (wherein i is an integer) to latch i pixel data VD, and each of the latches has a dimension corresponding to the bit number of the pixel data VD. Particularly, the timing controller 8 divides the pixel data VD into even pixel data $VD_{even}$ and odd pixel data $VD_{odd}$ to reduce a transmission frequency, and simultaneously outputs the data through each transmission line. Each of the even pixel data $VD_{even}$ and the odd pixel data $VD_{odd}$ includes red (R), green (G) and blue (B) pixel data. Thus, the latch part 36 simultaneously latches the even pixel data $VD_{even}$ and the odd pixel data $VD_{odd}$ supplied via the signal controller 20 for each sampling signal. Then, the latch part 36 simultaneously outputs i latched pixel data VD in response to a source output enable signal SOE from the signal controller 20.

The latch part 36 restores pixel data VD modulated such that the transition bit number is reduced in response to a data inversion selection signal REV to output them. The timing controller 8 modulates the pixel data VD such that the number of transition bits are minimized using a reference value to determine whether the bits should be inverted or not. This minimizes an electromagnetic interference (EMI) upon data transmission due to a minimal number of bit transactions from LOW to HIGH or HIGH to LOW.

The DAC 38 simultaneously converts the pixel data VD from the latch part 36 to positive and negative pixel voltage signals. The DAC 38 includes a positive (P) decoding part 40 and a negative (N) decoding part 42 commonly connected to the latch part 36, and a multiplexer (MUX) part 44 for selecting output signals of the P decoding part 40 and the N decoding part 42.

The n P decoders included in the P decoding part 40 convert n pixel data simultaneously input from the latch part 36 to positive pixel voltage signals using positive gamma voltages from the gamma voltage part 32. The i N decoders included in the N decoding part 42 convert i pixel data simultaneously input from the latch part 36 to negative pixel voltage signals using negative gamma voltages from the gamma voltage part 32. The i multiplexers included in the multiplexer part 44 selectively output the positive pixel voltage signals from the P decoder 40 or the negative pixel voltage signals from the N decoder 42 in response to a polarity control signal POL from the signal controller 20.

The i output buffers included in the output buffer part 46 are comprised of voltage followers, etc. connected, in series, to the respective i data lines DL1 to DLi. Such output buffers 46 buffer pixel voltage signals from the DAC 38 to apply the signals to the data lines DL1 to DLi.

Such a related art LCD differentiates output channels of the data IC's 16 included in the data driver 4 based upon a resolution of the liquid crystal display panel 2. This is because the data IC's 16 have certain channels connected to the data lines DL for each resolution of the liquid crystal display panel 2. Thus, problems arise in that a different number of data IC's 16 having different output channels for each resolution type of the liquid crystal display panel 2 need to be used. This reduces working efficiency and increases manufacturing cost.

More specifically, for a liquid crystal display having a resolution of an eXtended Graphics Array (XGA) class (i.e., 1024×3) with 3072 data lines DL iF requires four data IC's 16, each of which has 768 data output channels. For a liquid crystal display having a resolution of a Super eXtended Graphics Adapter+ (SXGA+) class (i.e., 1400×3) with 4200 data lines DL it requires six data IC's 16, each of which has 702 data output channels. The remaining 12 data output channels are treated as dummy lines. Additionally, a liquid crystal display having a resolution of a Wide eXtended Graphics Array (WXGA) class (i.e., 1280×3) with 3840 data lines DL, it requires six data IC's 16, each of which has 642 data output channels. In this case, the remaining 12 data output channels are treated as dummy lines. As mentioned above, different data IC's 16 having a specific number of output channels have to be used for each resolution of the liquid crystal display panel 2. As a result, the related art liquid crystal display has a drawback in that the working efficiency is reduced and manufacturing cost is increased.

SUMMARY OF THE INVENTION

Accordingly, the present invention is directed to a liquid crystal display (LCD) device that improves the working efficiency of the LCD, as well as reduce manufacturing costs.

An advantage of the present invention is to provide a liquid crystal display device that is capable of controlling output channels of data integrated circuits based upon a resolution of a liquid crystal display panel.

Additional features and advantages of the invention will be set forth in the description which follows, and in part will be apparent from the description, or maybe learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display according to one embodiment of the present invention includes N number of data output channels where N is an integer including a first data output channel and an Nth data output channel; a data output channel group including M data output channels (where M is an integer less than or equal to N), the M data output channels supplying pixel data to a corresponding number of data lines in accordance with a desired resolution of the display, wherein (N−M) data output channels are not applied with pixel data, and the (N−M) data output channels are located between the first data output channel and the Nth data output channel; and a channel selector selecting the M data output channels.

In another embodiment of the present invention, a data driving integrated circuit for connecting to a plurality of data lines of a display includes N number of data output channels where N is an integer including a first data output channel and an Nth data output channel; a data output channel group including M data output channels (where M is an integer less than or equal to N), the M data output channels supplying pixel data to a corresponding number of the data lines in accordance with a desired resolution of the display, wherein (N−M) data output channels are not applied with pixel data, and the (N−M) data output channels are located between the first data output channel and the Nth data output channel; and a channel selector selecting the M data output channels.

In another embodiment of the present invention, a data driving integrated circuit includes output channels including first, second and third output channel groups, the second output channel group being dummy output channels which do not receive pixel data; and a channel selector for selecting the first and third data output channel groups corresponding to a plurality of data lines of a display having a desired resolution, the channel selector being capable of selecting any one of the first, second and third data output groups as dummy output channels, wherein the second output channel group is located between the first and third output channel groups.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to an embodiment of the present invention, examples of which are illustrated in the accompanying drawings.

Figure 1:
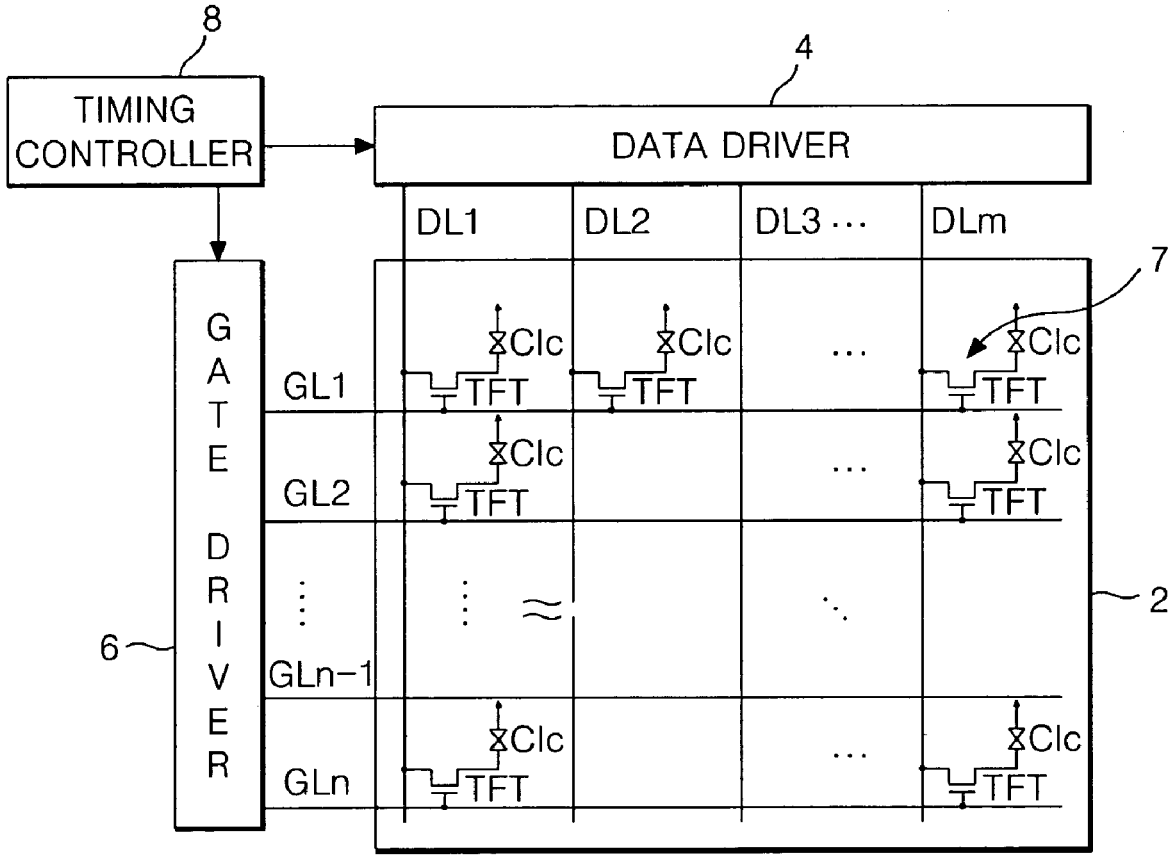
FIG. 1 RELATED ART
FIG. 1 is a block circuit diagram showing a related art liquid crystal display.
Figure 2A:
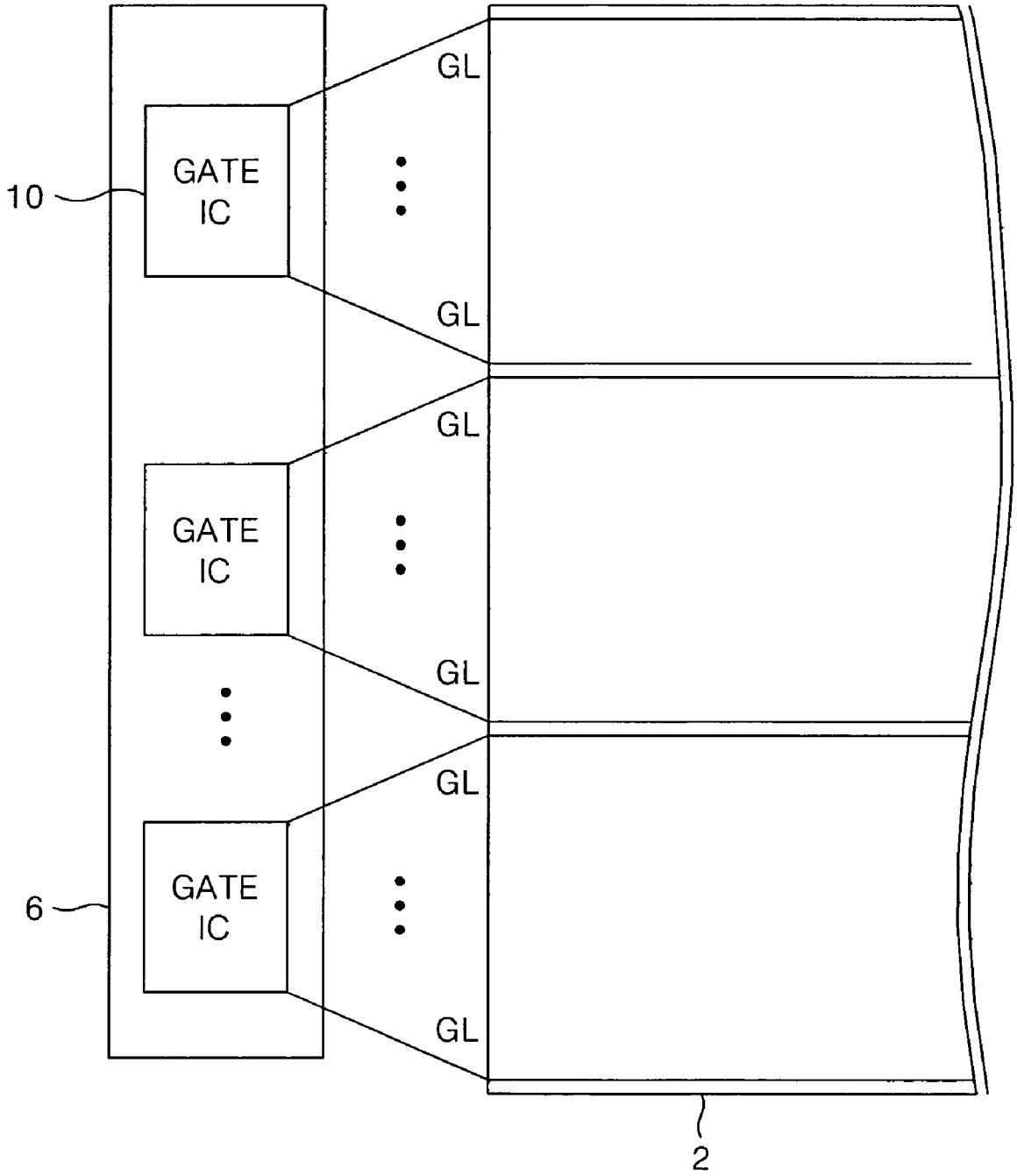
FIG.2A RELATED ART
FIG. 2A illustrates gate integrated circuits included in a related art gate driver.
Figure 2B:
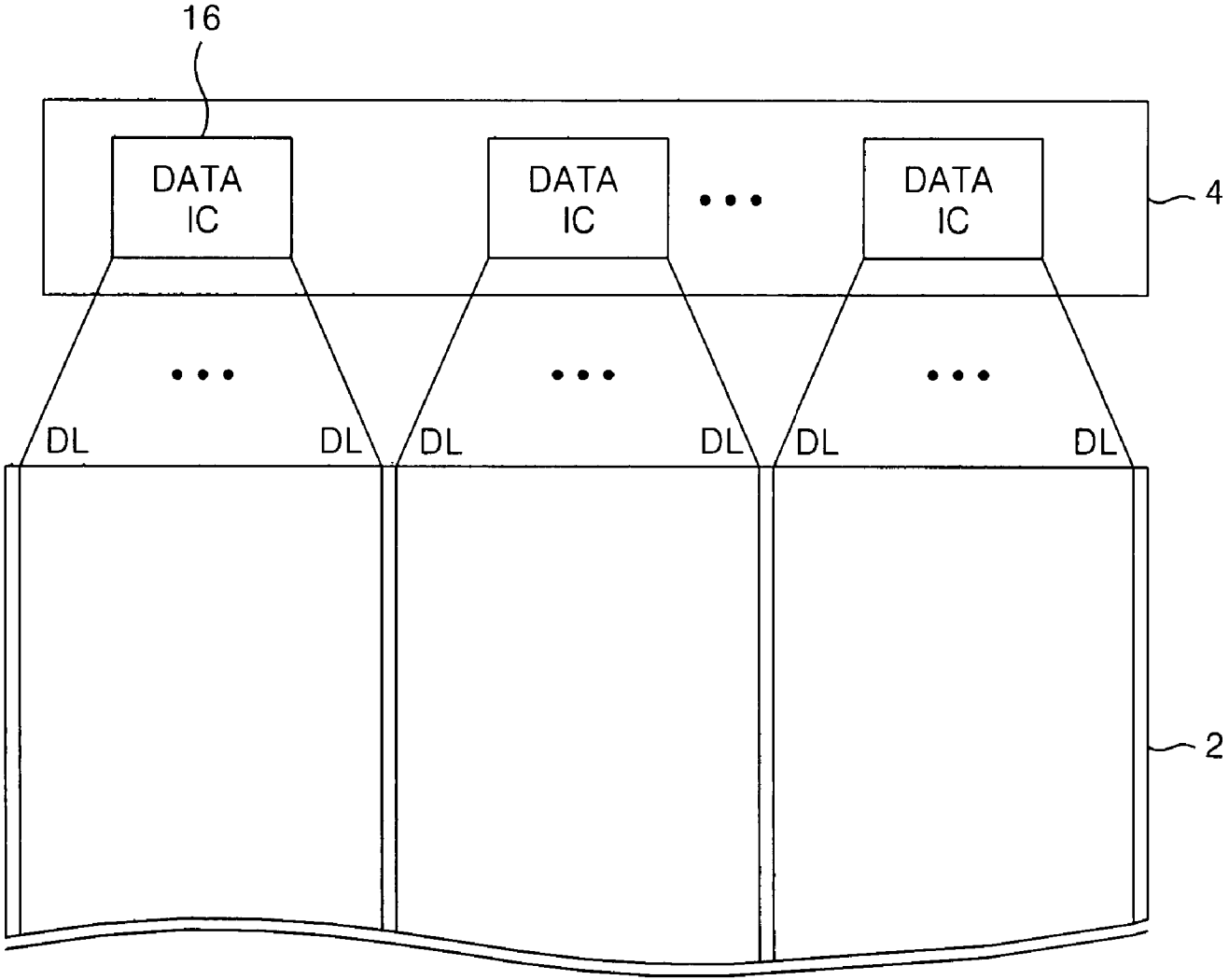
FIG.2B RELATED ART
FIG. 2B illustrates data integrated circuits included in a related art data driver.
Figure 3:
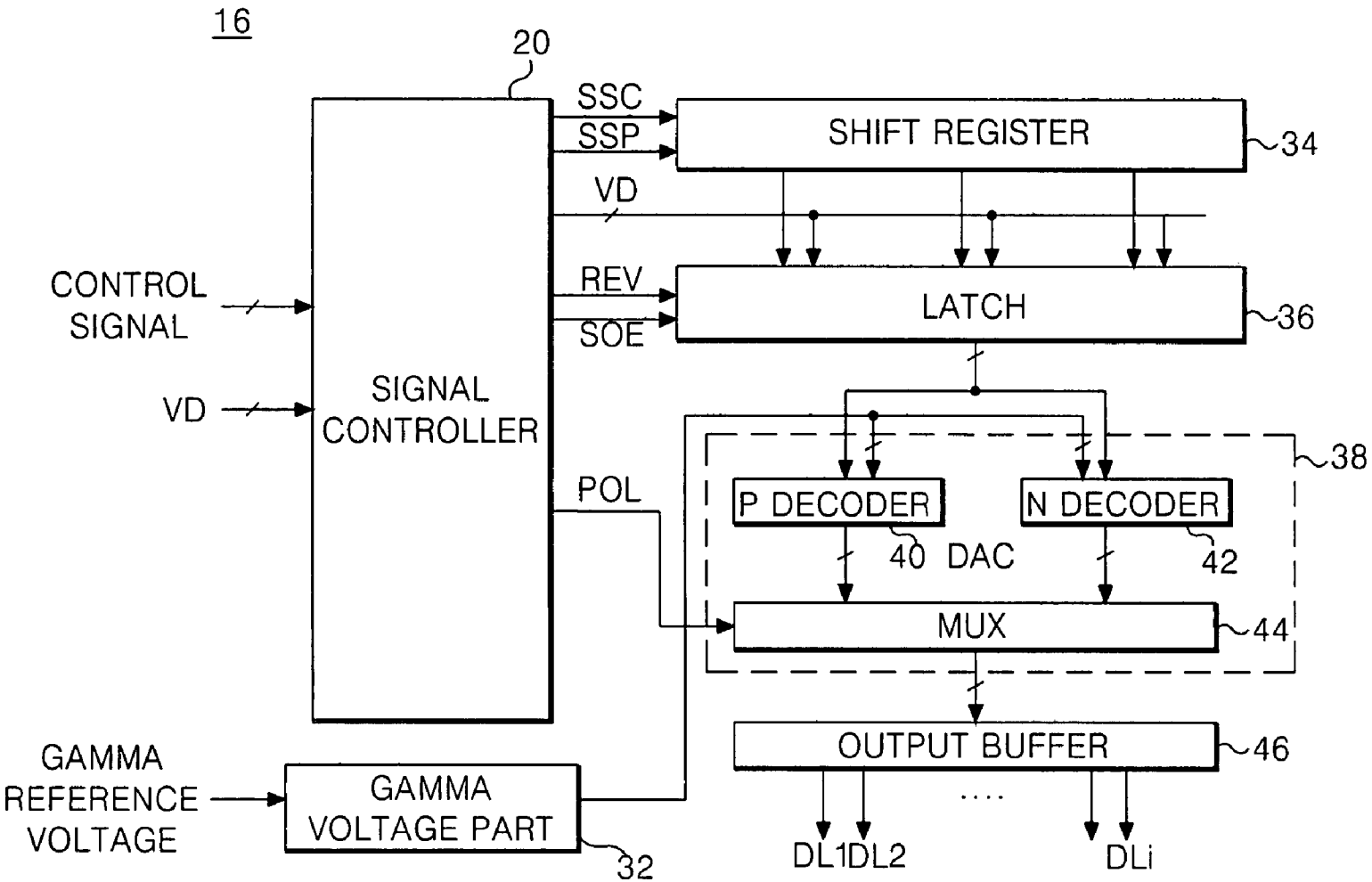
FIG. 3 RELATED ART
FIG. 3 is a block diagram showing an internal configuration of the data integrated circuit in FIG. 2B.
Figure 4:
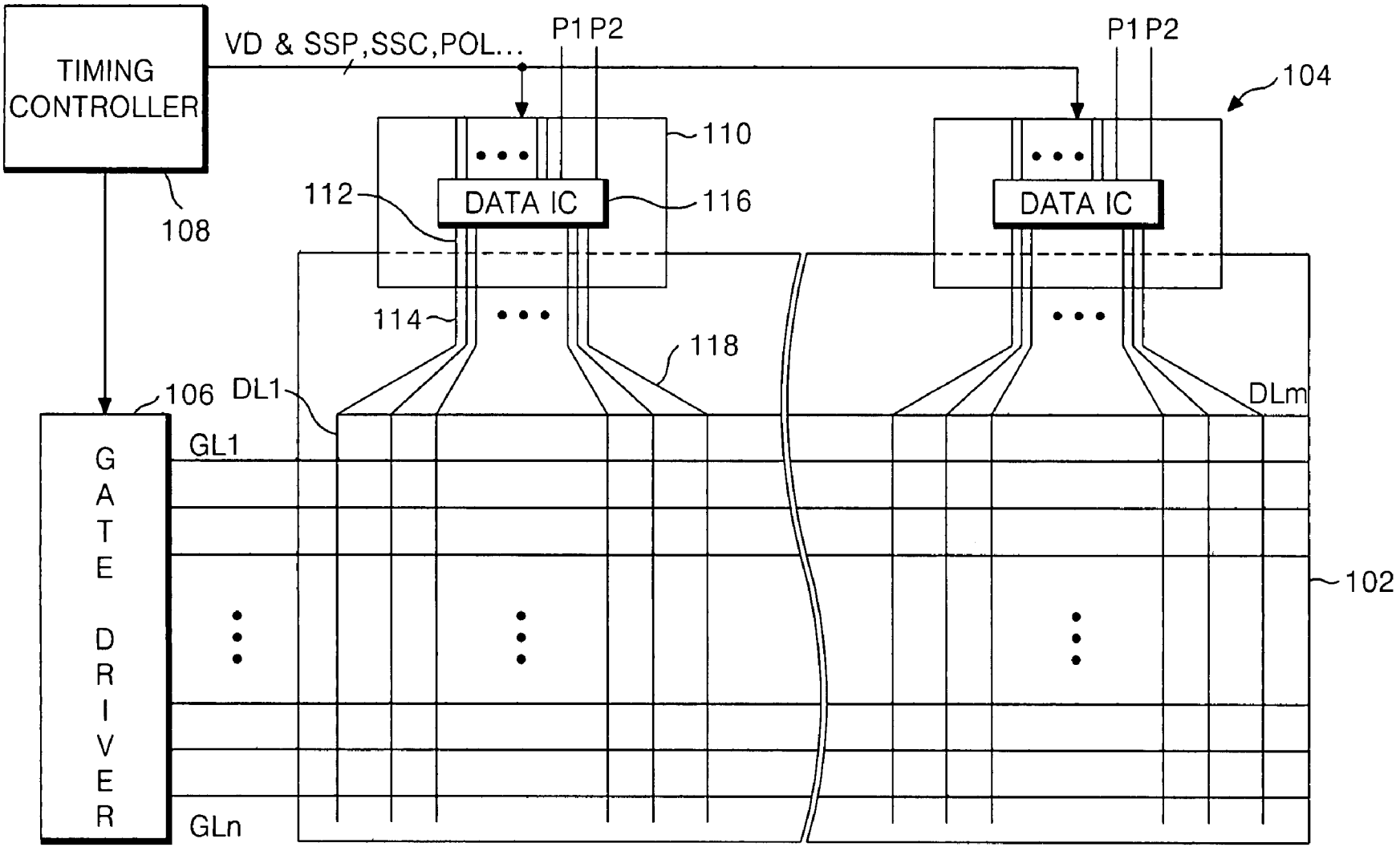
FIG. 4 is a block circuit diagram showing a liquid crystal display according to a first embodiment of the present invention.

FIG. 4 schematically shows a liquid crystal display (LCD) according to a first embodiment of the present invention.

In FIG. 4, the LCD includes a liquid crystal display panel 102 having liquid crystal cells arranged in a matrix, a gate driver 106 for driving gate lines GL1 to GLn of the liquid crystal display panel 102, a data driver 104 for driving data lines DL1 to DLm of the liquid crystal display panel 102, and a timing controller 108 for controlling the gate driver 106 and the data driver 104.

The liquid crystal display panel 102 includes a thin film transistor TFT provided at each crossing portion of the gate lines GL1 to GLn and the data lines DL1 to DLm, and a liquid crystal cell (not shown) connected to the thin film transistor TFT. The thin film transistor TFT is turned on when supplied with a scanning signal, that is, a gate high voltage VGH from the gate line GL, to apply a pixel signal from the data line DL to the liquid crystal cell. Further, the thin film transistor TFT is turned off when supplied with a gate low voltage VGL from the gate line GL. The pixel signal remains charged in the liquid crystal cell.

The liquid crystal cell can be equivalently represented as a liquid crystal capacitor. The liquid crystal cell includes a pixel electrode connected with a common electrode and a thin film transistor with a liquid crystal therebetween. Further, the liquid crystal cell includes a storage capacitor for maintaining the charged pixel signal until the next pixel signal is charged. This storage capacitor is provided between the pixel electrode and the pre-stage gate line. Such a liquid crystal cell 7 varies an alignment state of the liquid crystal having a dielectric anisotropy in accordance with a pixel signal charged through the thin film transistor TFT to control a light transmittance and implement gray scale levels.

The timing controller 108 generates gate control signals (i.e., gate start pulse (GSP), gate shift clock (GSC) and gate output enable (GOE)) and data control signals (i.e., source start pulse (SSP), source shift clock (SSC), source output enable (SOE) and polarity control (POL)) using synchronizing signals V and H supplied from a video card (not shown). The gate control signals (i.e., GSP, GSC and GOE) are applied to the gate driver 106 to control the gate driver 106 while the data control signals (i.e., SSP, SSC, SOE and POL) are applied to the data driver 104 to control the data driver 104. Further, the timing controller 108 aligns pixel data VD and applies the data to the data driver 104.

The gate driver 106 sequentially drives the gate lines GL1 to GLn. The gate driver 106 includes a plurality of gate integrated circuits (IC's) (not shown). The gate IC's sequentially drive the gate lines GL1 to GLn connected thereto under control of the timing controller 108. The gate IC's sequentially apply a gate high voltage VGH to the gate lines GL1 to GLn in response to the gate control signals (i.e., GSP, GSC and GOE) from the timing controller 108.

Specifically, the gate driver 106 shifts a gate start pulse GSP in response to a gate shift clock GSC to generate a shift pulse. Then, the gate driver 106 applies a gate high voltage VGH to the corresponding gate line GL for each horizontal period in response to the shift pulse. In other words, the shift pulse is shifted line-by-line for each horizontal period, and any one of the gate IC's applies the gate high voltage VGH to the corresponding gate line GL in accordance with the shift pulse. In this case, the gate IC's supply a gate low voltage VGL in the remaining gate lines.

The data driver 104 applies pixel signals to the data lines DL1 to DLm one line at a time each horizontal period. The data driver 104 includes a plurality of data IC's 116. Each of the data IC's 116 may be mounted in a data tape carrier package (TCP) 110. Such data IC's 116 are electrically connected, via a data TCP pad 112, a data pad 114 and a link 118, to the data lines DL1 to DLm. The data IC's 116 apply pixel signals to the data lines DL1 to DLm in response to data control signals (i.e., SSP, SSC, SOE and POL) from the timing controller 108. The data IC's 116 convert pixel data VD from the timing controller 108 to analog pixel signals using gamma voltages from a gamma voltage generator (not shown).

Specifically the data IC's 116 shift a source start pulse SSP in response to a source shift clock SSC to generate sampling signals. Then, the data IC's 116 sequentially latch the pixel data VD for a certain unit in response to the sampling signals. Thereafter, the data IC's 16 convert the latched pixel data VD for each line to analog pixel signals, and apply the analog data to the data lines DL1 to DLm in an enable interval of a source output enable signal SOE. The data IC's 116 convert the pixel data VD to positive or negative pixel signals in response to a polarity control signal POL.

Meanwhile, each of the data IC's 116 of the LCD according to the first embodiment of the present invention varies an output channel to apply a pixel signal to each data line DL1 to DLm in response to first and second channel selection signals P1 and P2 input from the exterior thereof. Each of the data IC's 116 includes first and second option pins OP1 and OP2, for example, supplied with the first and second channel selection signals P1 and P2.

Each of the first and second option pins OP1 and OP2 is selectively connected to a voltage source VCC and a ground voltage source GND to have a 2-bit binary logical value. Thus, the first and second channel selection signals P1 and P2 applied, via the first and second option pins OP1 and OP2 have values of '00', '01', '10' and '11' to the data IC 116.

Accordingly, each of the data IC's 116 has the number of an output channels set in advance based on a resolution type of the liquid crystal display panel 102 using the first and second channel selection signals P1 and P2 applied via the first and second option pins OP1 and OP2.

The number of data IC's 116 according to output channels of the data IC's 116 based upon a resolution of the liquid crystal display panel 102 is described in the following Table:

TABLE 1

| | Pixel number | | The number of data IC's according to output channels of data IC's | | | |
|---|---|---|---|---|---|---|
| Resolution | Data line | Gate line | 600 CH | 618 CH | 630 CH | 642 CH |
| XGA | 3072 | 768 | 5.12 | 4.97 | 4.88 | 4.79 |
| SXGA+ | 4200 | 1050 | 7.00 | 6.80 | 6.67 | 6.54 |
| UXGA | 4800 | 1200 | 8.00 | 7.77 | 7.62 | 7.48 |
| WXGA | 3840 | 800 | 6.40 | 6.21 | 6.10 | 5.98 |
| WSXGA− | 4320 | 900 | 7.20 | 6.99 | 6.86 | 6.73 |
| WSXGA | 5040 | 1050 | 8.40 | 8.16 | 8.00 | 7.85 |
| WUXGA | 5760 | 1200 | 9.60 | 9.32 | 9.14 | 8.97 |

In Table 1, all resolutions can be expressed by four channels. Specifically, the liquid crystal display panel 102 having a resolution of XGA class requires five data IC's 116, each of which has 618 data output channels. The remaining 18 data output channels are treated as dummy lines. The liquid crystal display panel 102 having a resolution of SXGA+ class requires seven data IC's 116, each of which has 600 data output channels. The liquid crystal display panel 102 having a resolution of Ultra eXtended Graphics Adapter (UXGA) class requires eight data IC's 116, each of which has 600 data output channels. The liquid crystal display panel 102 having a resolution of WXGA class requires six data IC's 116, each of which has 642 data output channels. The liquid crystal display panel 102 having a resolution of Wide aspect Super eXtended Graphics Adapter− (WSXGA−) class requires seven data IC's 116, each of which has 618 data output channels. The liquid crystal display panel 102 having a resolution of Wide aspect Super eXtended Graphics Adapter (WSXGA) class requires eight data IC's 116, each of which has 630 data output channels. The liquid crystal display panel 102 having a resolution of Wide aspect Ultra eXtended Graphics Adapter (WUXGA) class requires nine data IC's 116, each of which has 642 data output channels.

The LCD according to the first embodiment of the present invention sets the number of output channels of the data IC's 116 to any one of 600 channels, 618 channels, 630 channels and 642 channels in response to the first and second channel selection signals P1 and P2, thereby expressing all resolutions of the liquid crystal display panel 102. The data IC 116 of the LCD according to the first embodiment of the present invention may be made to have 642 data output channels and the number of active output channels of the data IC's 116 are set in response to the first and second channel selection signals P1 and P2 from the first and second option pins OP1 and OP2, for example, so that it can be compatibly used for all resolution types of the liquid crystal display panel 102.

Figure 5:
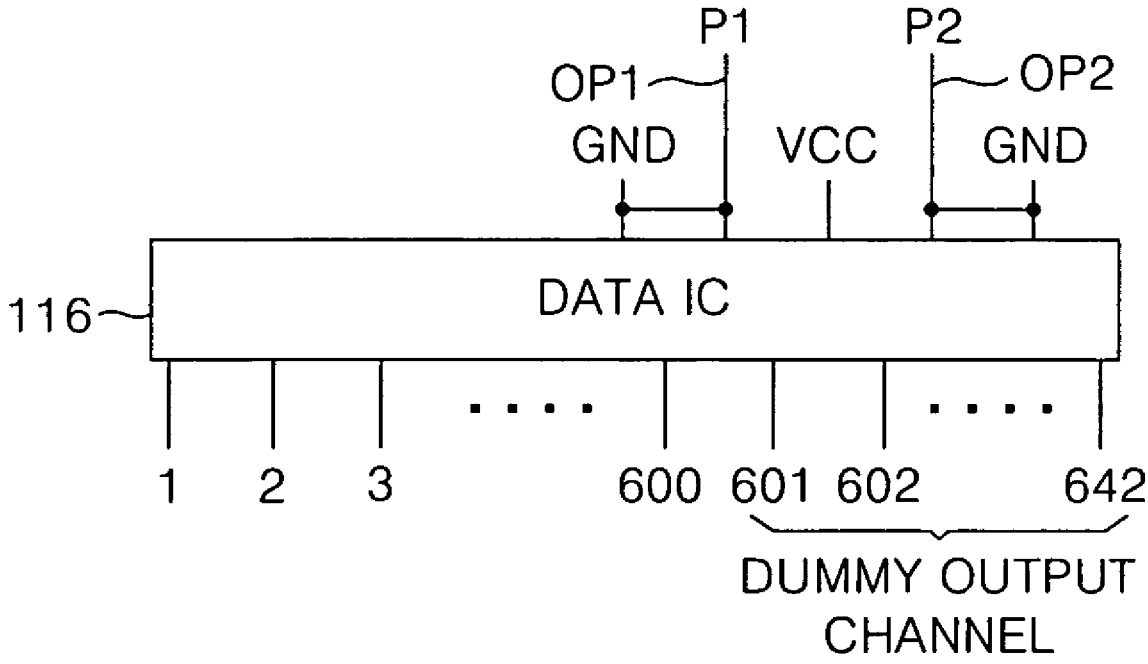
FIG. 5 illustrates a data integrated circuit set to have 600 data output channels in accordance with first and second output selection signals shown in FIG. 4.
Figure 6:
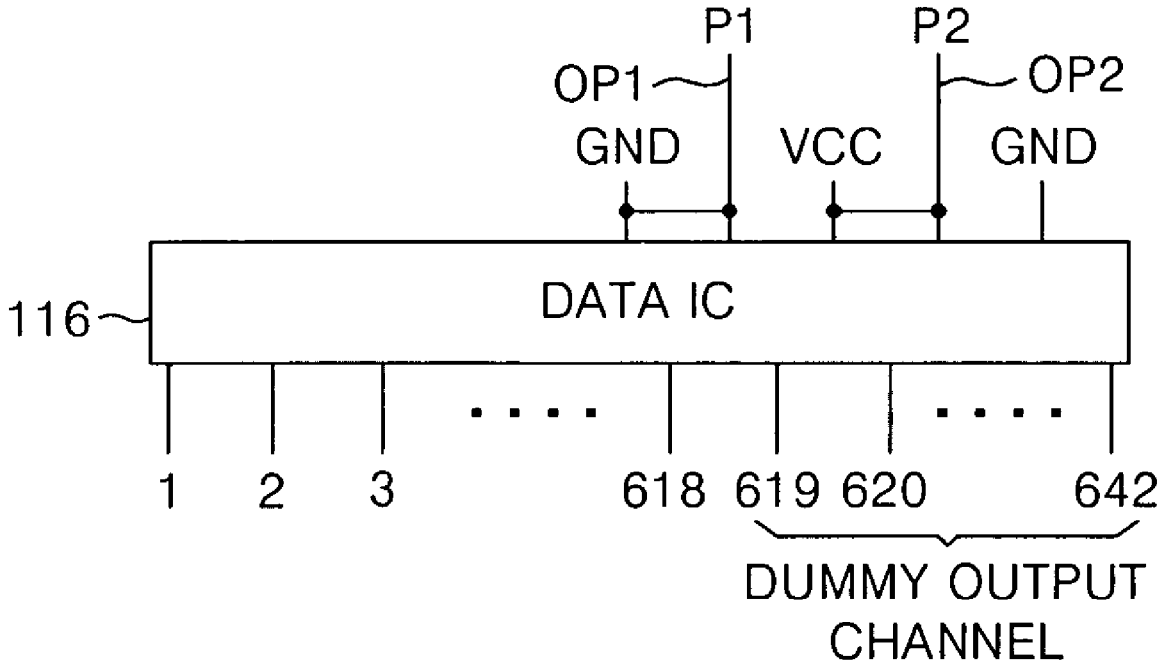
FIG. 6 illustrates a data integrated circuit set to have 618 data output channels in accordance with first and second output selection signals shown in FIG. 4.
Figure 7:
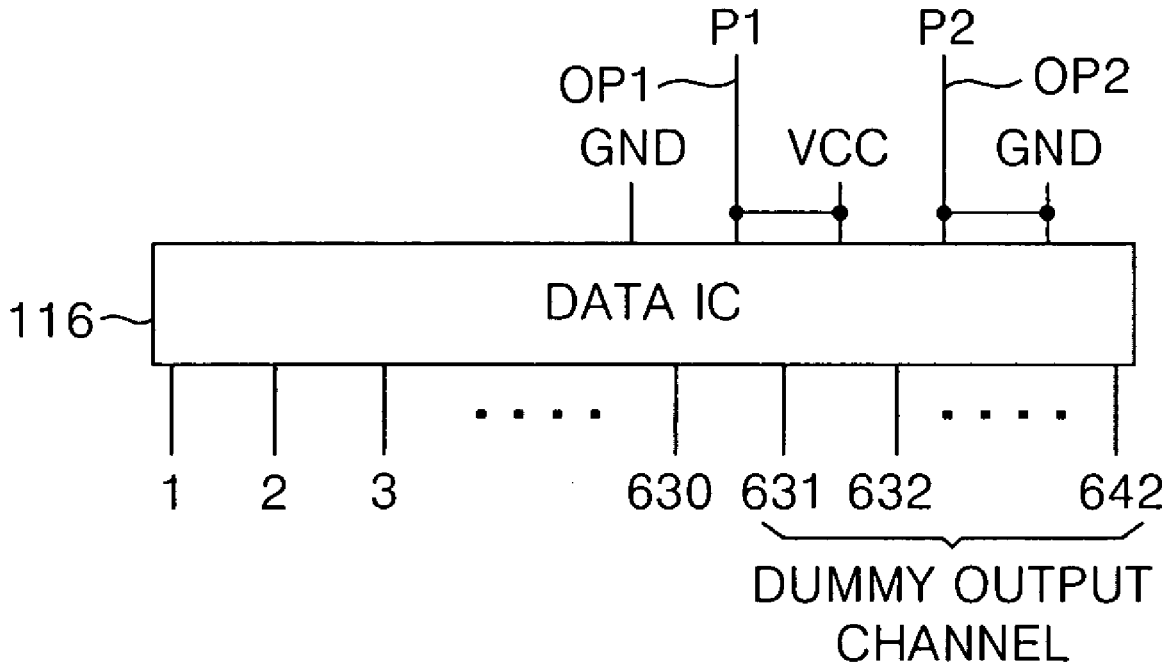
FIG. 7 illustrates a data integrated circuit set to have 630 data output channels in accordance with first and second output selection signals shown in FIG. 4.
Figure 8:
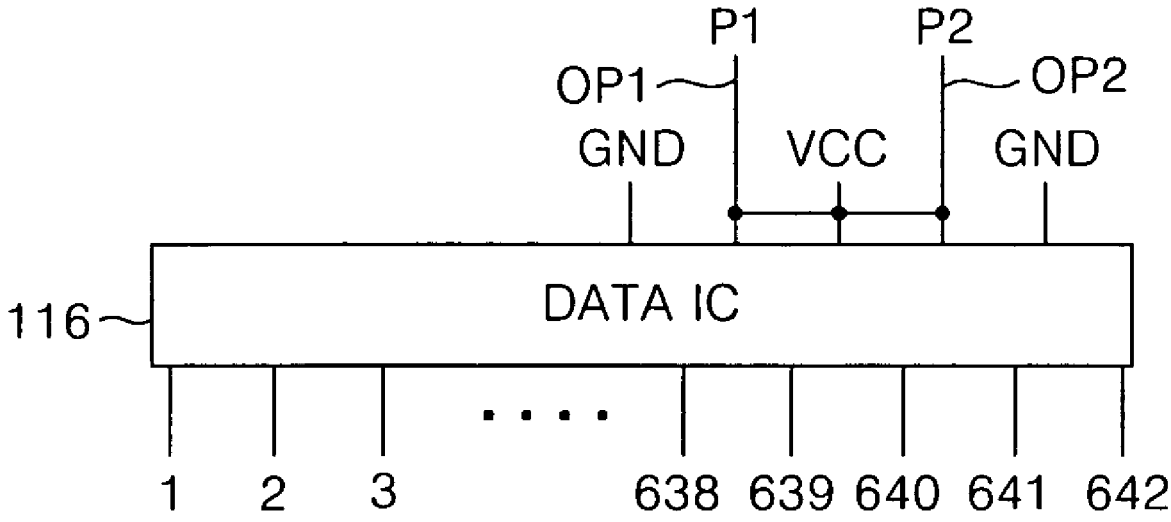
FIG. 8 illustrates a data integrated circuit set to have 642 data output channels in accordance with first and second output selection signals shown in FIG. 4.

The data IC 116 of the LCD according to the first embodiment of the present invention may be manufactured to have 642 data output channels. When a value of the first and second channel selection signals P1 and P2 applied to the data IC 116 is '00' by connecting each of the first and second option pins OP1 and OP2 to the ground voltage source GND, the data IC 116 outputs pixel voltage signals via only the 1st to 600th data output channels from the 642 data output channels available as shown in FIG. 5. In this case, the 601st to 642nd output channels become dummy output channels. On the other hand, when a value of the first and second channel selection signals P1 and P2 applied to the data IC 116 is '01' by connecting the first option pin OP1 to the ground voltage source GND and the second option pin OP2 to the voltage source VCC, the data IC 116 outputs pixel voltage signals via only the 1st to 618th data output channels from 642 data output channels available as shown in FIG. 6. In this case, the 619th to 642nd output channels become dummy output channels. When a value of the first and second channel selection signals P1 and P2 applied to the data IC 116 is '10' by connecting the first option pin OP1 to the voltage source VCC and, the second option pin OP2 to the ground voltage source GND, the data IC 116 outputs pixel voltage signals via only 1st to 630th data output channels of 642 data output channels from the 642 data output channels available as shown in FIG. 7. The 631st to 642nd output channels become dummy output channels. Finally, when a value of the first and second channel selection signals P1 and P2 applied to the data IC 116 is '11' by connecting each of the first and second option pins OP1 and OP2 to the voltage source VCC, the data IC 116 outputs pixel voltage signals via the 1st to 642nd data output channels, as shown in FIG. 8.

Figure 9:
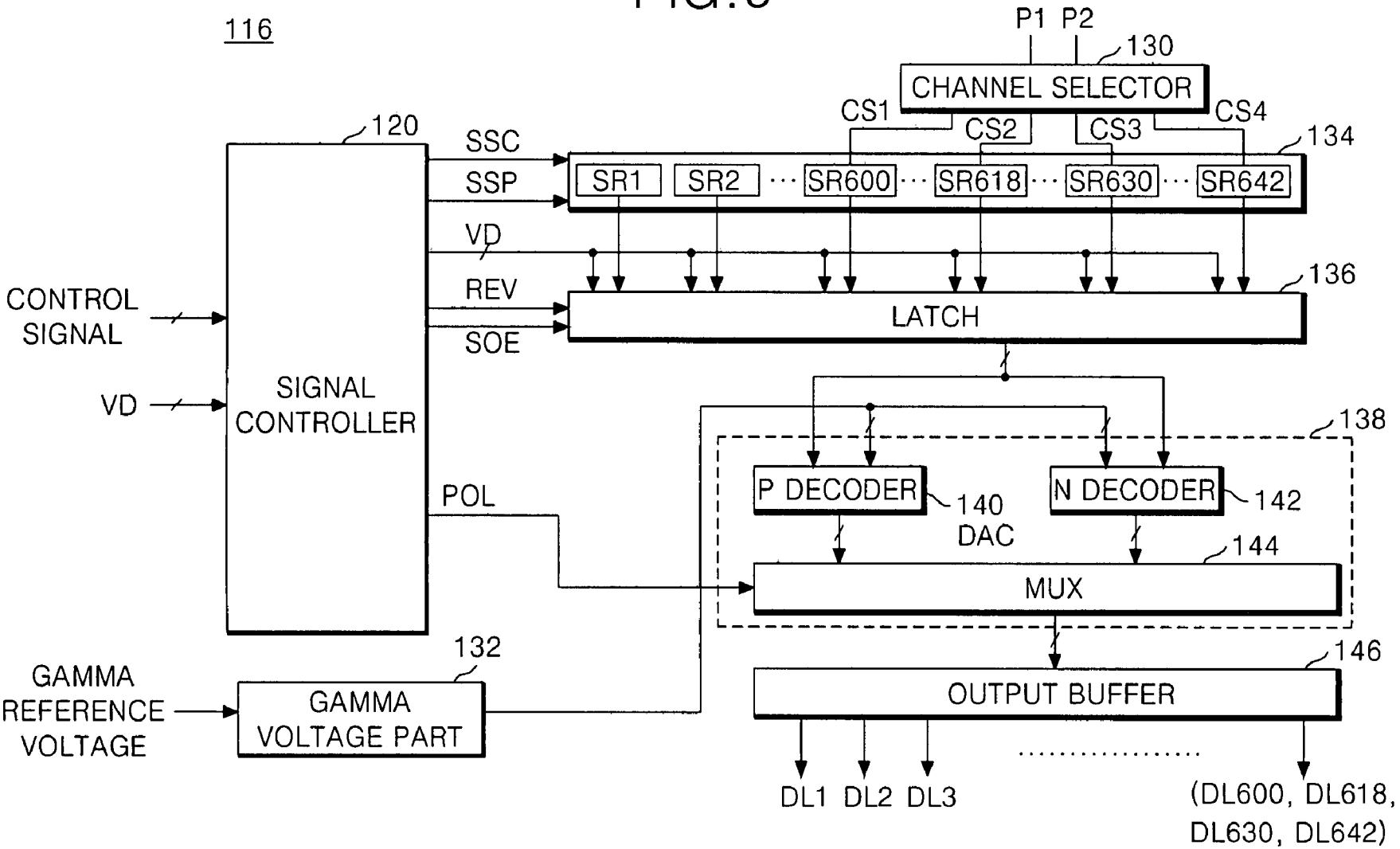
FIG. 9 is a block diagram showing an internal configuration of the data integrated circuit in FIG. 4.

As shown in FIG. 9, the data IC 116 of the LCD according to the first embodiment of the present invention includes a channel selector 130 for setting an output channel of the data IC 116 in response to the first and second channel selection signals P1 and P2 applied to the first and second option pins OP1 and OP2, for example, a shift register part 134 for sequentially applying sampling signals, a latch part 136 for sequentially latching the pixel data VD in response to the sampling signals from the shift register part 134 to simultaneously output the data a digital-to-analog converter (DAC) 138 for converting the pixel data VD from the latch part 136 to pixel voltage signals, and an output buffer part 146 for buffering pixel voltage signals from the DAC 138 to output them to the data lines.

The data IC 116 further includes a signal controller 120 for interfacing with various control signals from the timing controller 108 and the pixel data VD, and a gamma voltage part 132 for supplying positive and negative gamma voltages required for the DAC 138.

The signal controller 120 controls various control signals (i.e., SSP, SSC, SOE, REV and POL, etc.) from the timing controller 108 and the pixel data VD so as to output them to the corresponding elements.

The gamma voltage part 132 sub-divides a plurality of gamma reference voltages input from a gamma reference voltage generator (not shown) for each gray level.

The channel selector 130 applies first to fourth channel control signals CS1 to CS4, via the first and second option pins OP1 and OP2, to the shift register part 134 in response to the first and second channel selection signals P1 and P2. In other words, the channel selector 130 generates the first channel selection signal CS1 corresponding to the first and second channel selection signals P1 and P2 having a value of '00', the second channel selection signal CS2 corresponding to the first and second channel selection signals P1 and P2 having a value of '01', the third channel selection signal CS3 corresponding to the first and second channel selection signals P1 and P2 having a value of '10', and the fourth channel selection signal CS4 corresponding to the first and second channel selection signals P1 and P2 having a value of '11'.

Shift registers included in the shift register part 134 sequentially shift a source start pulse SSP from the signal controller 120 in response to a source sampling clock signal SSC and output a sampling signal. In this example, the shift register part 134 consists of 642 shift registers SR1 to SR642.

Such a shift register part 134 applies output signals of the 600th, 618th, 630th and 642nd shift registers SR600, SR628, SR630 and SR642 to a next stage data IC 116 in response to the first to fourth channel control signals CS1 to CS4 from the channel selector 130.

More specifically, when the first output control signal CS1 is applied from the channel selector 130, the shift register part 134 sequentially shifts a source start pulse SSP signal from the signal controller 120 in response to a source sampling clock signal SSC using the 1st to 600th shift registers SR1 to SR600, and outputs them as sampling signals. In this case, an output signal (i.e., a carry signal) of the 600th shift register SR600 is applied to the 1st shift register SR1 of the next stage data IC 116 for a daisey chain connection. Thus, the 601st to 642nd shift registers SR601 to SR642 do not output sampling signals. If the shift registers are driven in a bilateral direction, then it becomes possible to more advantageously use them by using a dummy treatment without employing the 42 middle channels.

When the second output control signal CS2 is applied from the channel selector 130, the shift register part 134 sequentially shifts a source start pulse SSP signal from the signal controller 120 in response to a source sampling clock signal SSC using the 1st to 618th shift registers SR1 to SR618, and outputs them as sampling signals. In this case, an output signal (i.e., a carry signal) of the 618th shift register SR618 is applied to the 1st shift register SR1 of the next stage data IC 116. Thus, the 619th to 642nd shift registers SR619 to SR642 do not output sampling signals. If the shift registers are driven in a bilateral direction, then it is possible to more advantageously use the shift registers by making a dummy treatment without employing the 24 middle channels.

When the third output control signal CS3 is applied from the channel selector 130, the shift register part 134 sequentially shifts a source start pulse SSP signal from the signal controller 120 in response to a source sampling clock signal SSC using the 1st to 630th shift registers SR1 to SR630, and outputs them as sampling signals. In this case, an output signal (i.e., a carry signal) of the 630th shift register SR630 is applied to the 1st shift register SR1 of the next stage data IC 116. Thus, the 631st to 642nd shift registers SR631 to SR642 do not output sampling signals. Herein, if the shift registers are driven in a bilateral direction, then it is possible to more advantageously use the shift registers by using a dummy treatment without employing the 12 middle channels.

When the fourth output control signal CS4 is applied from the channel selector 130, the shift register part 134 sequentially shifts a source start pulse SSP signal from the signal controller 120 in response to a source sampling clock signal SSC using the 1st to 642nd shift registers SR1 to SR642, and outputs them as sampling signals. In this case, an output signal (i.e., a carry signal) of the 642nd shift register SR642 is applied to the 1st shift register SR1 of the next stage data IC 116.

The latch part 136 sequentially samples the pixel data VD from the signal controller 120 for a particular unit in response to the sampling signals from the shift register part 134 to latch them. To this end, the latch part 136 is comprised of at most 642 latches so as to latch 642 pixel data VD, and each of the latches has a dimension corresponding to a bit number of the pixel data VD. Particularly, the timing controller 108 divides the pixel data VD into even pixel data $VD_{even}$ and odd pixel data $VD_{odd}$ to reduce a transmission frequency, and simultaneously outputs the data through each transmission line. Each of the even pixel data $VD_{even}$ and the odd pixel data $VD_{odd}$ includes red (R), green (G) and blue (B) pixel data.

The latch part 136 simultaneously latches the even pixel data $VD_{even}$ and the odd pixel data $VD_{odd}$ supplied via the signal controller 120 for each sampling signal. Then, the latch part 136 simultaneously outputs the pixel data VD through the selected number of output channels, (600, 618, 630 or 642 data output channels) in response to a source output enable signal SOE from the signal controller 120. The latch part 136 restores pixel data VD which have been modulated such that the transition bit number is reduced in response to a data inversion selection signal REV. This is because the timing controller 108 modulates the pixel data VD, in which the transited bit number goes beyond a reference value, such that the transition bit number is reduced so as to minimize an electromagnetic interference (EMI) upon data transmission.

The DAC 138 simultaneously converts the pixel data VD from the latch part 136 to positive and negative pixel voltage signals. The DAC 138 includes a positive. (P) decoding part 140 and a negative (N) decoding part 142 commonly connected to the latch part 136, and a multiplexer (MUX) part 144 for selecting output signals of the P decoding part 140 and the N decoding part 142.

The n P decoders included in the P decoding part 140 convert n pixel data simultaneously input from the latch part 136 to positive pixel voltage signals using positive gamma voltages from the gamma voltage part 132. The i N decoders included in the N decoding part 142 convert i pixel data simultaneously input from the latch part 136 to negative pixel voltage signals using negative gamma voltages from the gamma voltage part 132. In the example, at most 642 multiplexers included in the multiplexer part 144 selectively output the positive pixel voltage signals from the P decoder 140 or the negative pixel voltage signals from the N decoder 142 in response to a polarity control signal POL from the signal controller 120.

At most, 642 output buffers included in the output buffer part 146 include voltage followers, etc. connected, in series, to the respective 642 data lines DL1 to DL642. Such output buffers 146 buffer pixel voltage signals from the DAC 138 to apply the signals to the data lines DL1 to DL642.

In the LCD according to the first embodiment of the present invention, the data IC 116 having 600 data output channels is used for the liquid crystal display panel 102 having a resolution of SXGA+ class or UXGA class; the data IC 116 having 618 data output channels is used for the liquid crystal display panel 102 having a resolution of XGA class or WSXGA– class; the data IC 116 having 630 data output channels is used for the liquid crystal display panel 102 having a resolution of WSXGA class; and the data IC 116 having 642 data output channels is used for the liquid crystal display panel 102 having a resolution of WXGA class or WUXGA class as indicated in the above Table 1.

Meanwhile, in the LCD according to the first embodiment of the present invention, the TCP pad 112, the data pad 114 of the liquid crystal display panel 102 and the link 118 correspond to output channels of the data IC 116 varied in response to the first and second channel selection signals P1 and P2.

The LCD according to the first embodiment of the present invention sets the number of output channels of the data IC 116 in accordance with a resolution of the liquid crystal display panel 102 as indicated in the above Table 1 using the first and second channel selection signals P1 and P2 applied to the first and second option pins OP1 and OP2, thereby configuring multiple resolutions using only one type of data IC 116. Accordingly, the LCD according to the first embodiment of the present invention improves the working efficiency of an LCD device as well as reduce manufacturing cost.

Figure 10:
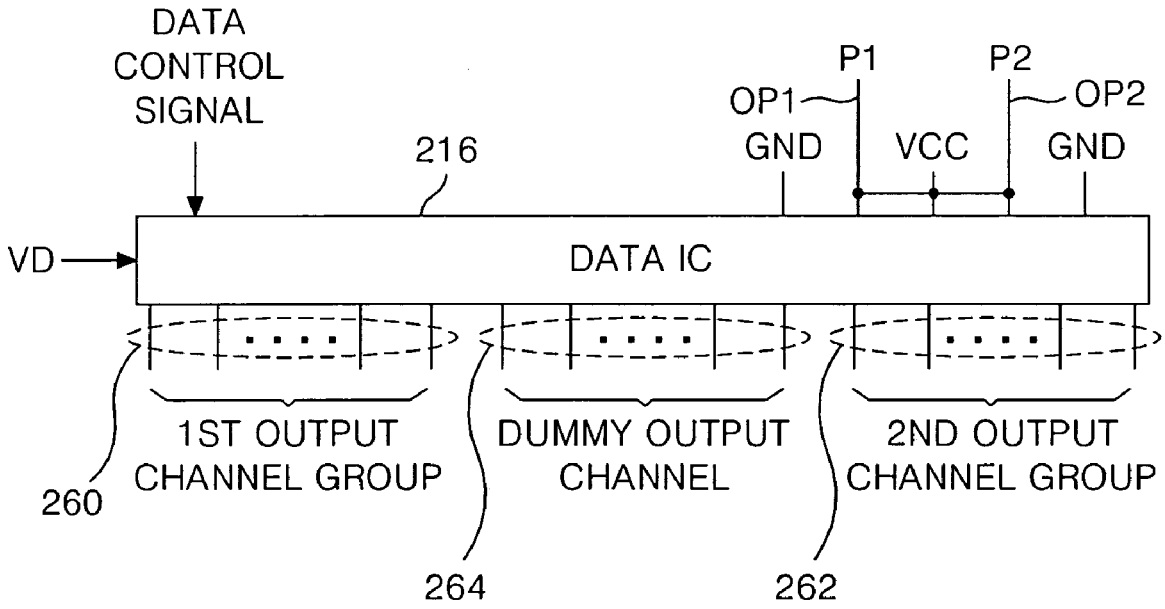
FIG. 10 is a block circuit diagram showing a liquid crystal display according to a second embodiment of the present invention.

FIG. 10 is a block diagram showing a configuration of a data IC in a liquid crystal display according to a second embodiment of the present invention.

In FIG. 10, the LCD according to the second embodiment of the present invention has the same elements as the LCD according to the first embodiment of the present invention except for a data IC 216. Therefore, in the LCD according to the second embodiment of the present invention, the data IC 216 will be described in conjunction with FIG. 10 and FIG. 4, and an explanation as to similar elements will be omitted. Herein, a reference numeral "116" of the data IC shown in FIG. 4.

In the LCD according to the second embodiment of the present invention, the data IC 216 includes a first data output channel group 260 and a second data output channel group 262 for applying data to the data lines DL1 to DLm, and a dummy output channel group 264 provided between the first and second data output channel groups 260 and 262.

The data IC 216 further includes first and second option pins OP1 and OP2 supplied with first and second channel selection signals P1 and P2 for determining whether a pixel data applied, via a dummy data output channel group 264, to the data lines DL1 to DLm in accordance with the number of the data lines DL1 to DLm is output.

Each of the first and second option pins OP1 and OP2 is selectively connected to a voltage source VCC and a ground voltage source GND to have a 2-bit binary logical value. Thus, the first and second channel selection signals P1 and P2 applied, via the first and second option pins OP1 and OP2, to the data IC 216 may have values of '00', '01', '10' and '11'.

Accordingly, each of the data IC's 216 has output channels set in advance based on a desired resolution of the liquid crystal display panel 102 using first and second channel selection signals P1 and P2 applied via the first and second option pins OP1 and OP2.

The number of data IC's 216 according to output channels of the data IC's 216 is based upon a resolution of the liquid crystal display panel 102 as indicated in the above Table 1.

Accordingly, the LCD according to the second embodiment of the present invention may set output channels of the data IC's 216, for example, to any one of 600 channels, 618 channels, 630 channels and 642 channels in response to the first and second channel selection signals P1 and P2, thereby configuring multiple resolutions of the liquid crystal display panel 102. In other words, the data IC 216 of the LCD according to the second embodiment of the present invention may be set to have 642 data output channels that are set in response to the first and second channel selection signals P1 and P2 from the first and second option pins OP1 and OP2, so that the data IC 216 can be compatibly used for all resolutions of the liquid crystal display panel 102. Further, in the LCD according to the second embodiment, the dummy data output channel group 264 of the data IC 216 is arranged according to a determination of the output channel at the middle portion of data output channels of the data IC 216. In other words, first and second data output channel groups 260 and 262 of the data IC 216 have the same output channels, with the dummy data output channel group 264 therebetween. Thus, the LCD according to the second embodiment of the present invention equalizes the output channels of each of the first and second data output channel groups 260 and 262 of the data IC 216, which reduces an electromagnetic interference upon output of the pixel data.

The data IC 216 of the LCD according to the second embodiment of the present invention may be manufactured to have, for example, 642 data output channels.

Figure 11:
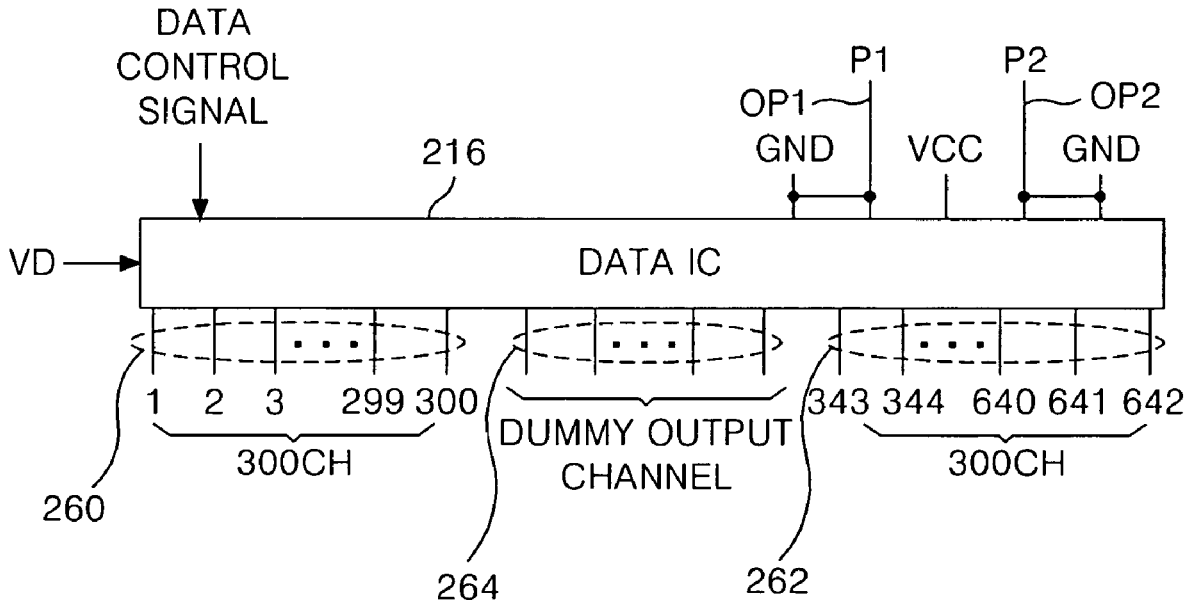
FIG. 11 illustrates a data integrated circuit set to have 600 data output channels in accordance with first and second output selection signals shown in FIG. 10.

When a value of the first and second channel selection signals P1 and P2 applied to the data IC 216 is '00', by connecting each of the first and second option pins OP 1 and OP2 to the ground voltage source GND, the data IC 216 outputs pixel data via the first data output channel group 260 having the 1st to 300th output channels. From the 642 data output channels available and the second data output channel group 262 having the 343rd from the 642nd output channels available as shown in FIG. 11. The dummy data output channel group 264 has the 301st to 342nd output channels which are treated as dummy lines.

Figure 12:
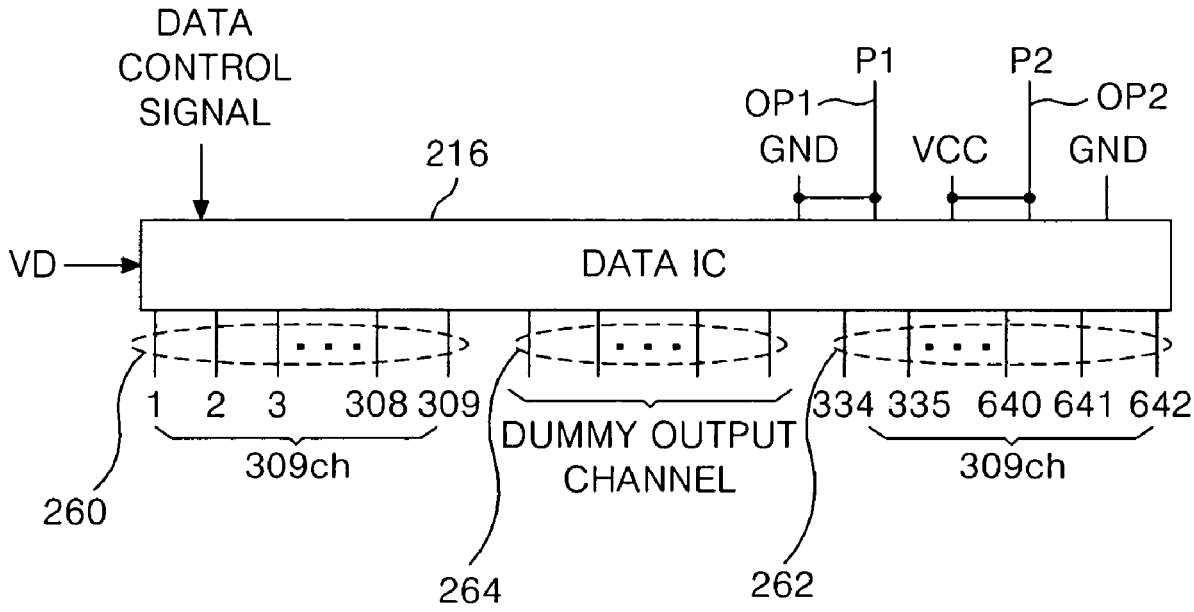
FIG. 12 illustrates a data integrated circuit set to have 618 data output channels in accordance with first and second output selection signals shown in FIG. 10.

In FIG. 12, when a value of the first and second channel selection signals P1 and P2 applied to the data IC 216 is '01', by connecting the first option pin OP1 the ground voltage source GND and, the second option pin OP2 to the voltage source VCC, the data IC 216 outputs pixel data via the first data output channel group 260 having the 1st to 309th output channels. From the 642 data output channels and the second data output channel group 262 having the 334th from the 642nd output channels as shown in FIG. 12. The dummy data output channel group 264 has the 310th to 333rd output channels which are treated as dummy lines.

Figure 13:
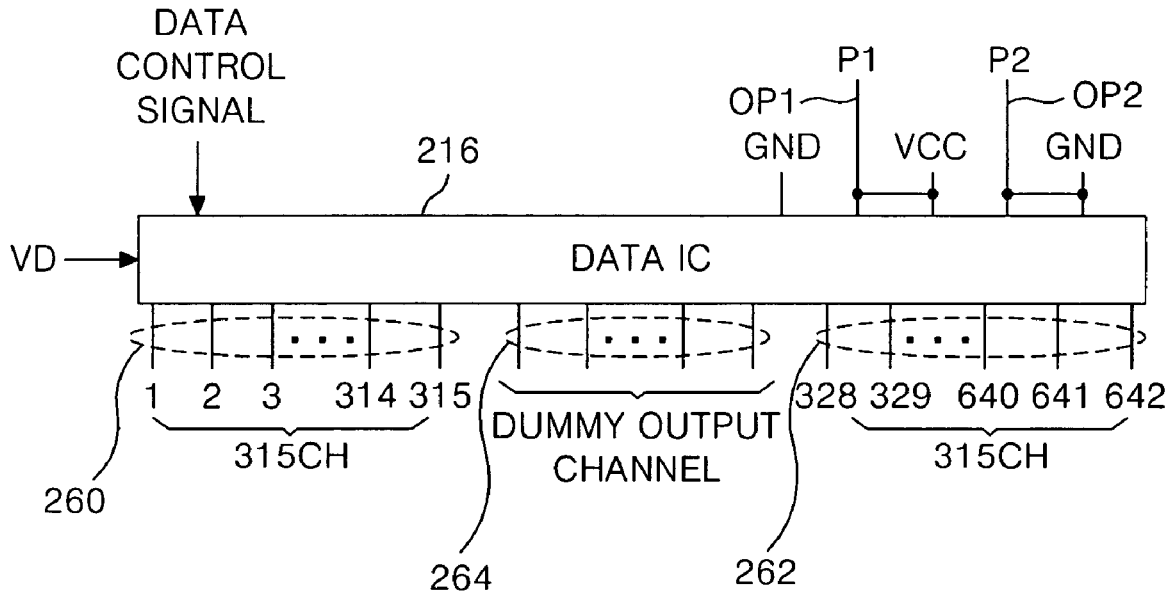
FIG. 13 illustrates a data integrated circuit set to have 630 data output channels in accordance with first and second output selection signals shown in FIG. 10.

In FIG. 13, when a value of the first and second channel selection signals P1 and P2 applied to the data IC 216 is '10' by connecting the first option pin OP1 to the voltage source VCC and, the second option pin OP2 to the ground voltage source GND, the data IC 216 outputs pixel data via the first data output channel group 260 having the 1st to 315th output channels from the 642 data output channels and the second data output channel group 262 having the 328th from the 642nd output channels available as shown in FIG. 13. The dummy data output channel group 264 has the 316th to 327th output channels which are treated as dummy lines thereby.

Figure 14:
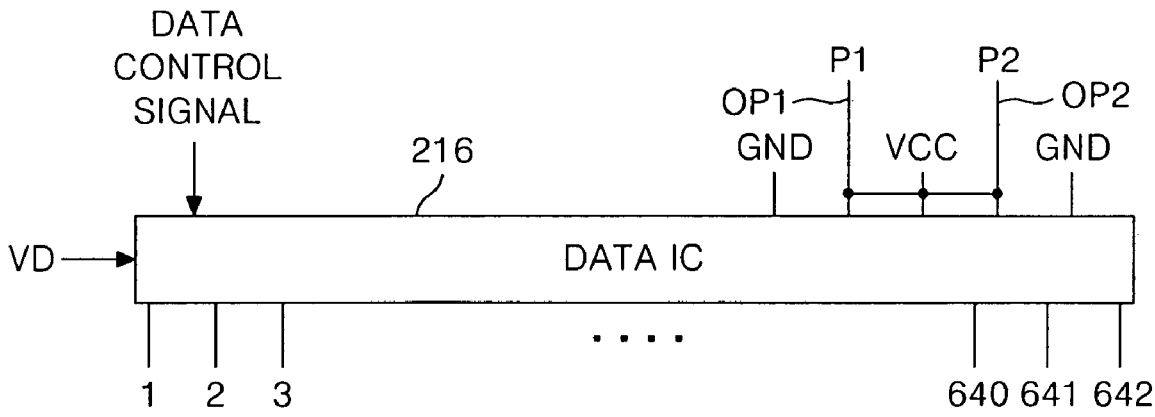
FIG. 14 illustrates a data integrated circuit set to have 642 data output channels in accordance with first and second output selection signals shown in FIG. 10.

Finally, in FIG. 14, when a value of the first and second channel selection signals P1 and P2 applied to the data IC 216 is '11' by connecting each of the first and second option pins OP1 and OP2 to the voltage source VCC, the data IC 216 outputs pixel data via the first data output channel group 260, the dummy data output channel group 264 and the second output channel group 262, that is, via the 1st to 642nd data output channels as shown in FIG. 14.

To this end, similar to FIG. 9, the data IC 216 of the LCD according to the second embodiment of the present invention includes a channel selector 130 for setting an output channel of the data IC 216 in response to the first and second channel selection signals P1 and P2 applied to the first and second option pins OP1 and OP2, a shift register part 134 for sequential applying sampling signals, a latch part 136 for sequentially latching the pixel data VD in response to the sampling signals to simultaneously output the data, a digital to analog converter (DAC) 138 for converting the pixel data VD from the latch part 136 to pixel voltage signals, and an output buffer part 146 for buffering pixel voltage signals from the DAC 138.

The data IC 216 further includes a signal controller 120 for interfacing various control signals from the timing controller 108 and the pixel data VD, and a gamma voltage part 132 for supplying positive and negative gamma voltages required for the DAC 138.

Because the data IC 216 including the channel selector 130, the shift register part 134, the latch part 136, the DAC 138, the output buffer part 146, the signal controller 120 and the gamma voltage part are identical to the data IC 116 of the LCD according to the first embodiment of the present invention, an explanation as to the similar elements will be replaced by the above-mentioned description.

As described above, the LCD according to the second embodiment of the present invention sets the output channels of the data IC 216 based upon a resolution of the liquid crystal display panel 102, as indicated in the above Table 1 in response to the first and second channel selection signals P1 and P2 applied to the first and second option pins OP1 and OP2, thereby expressing all resolutions only by a kind of data IC 216. Accordingly, the LCD according to the second embodiment of the present invention improves a working efficiency of the LCD as well as reduces manufacturing costs.

Figure 15:
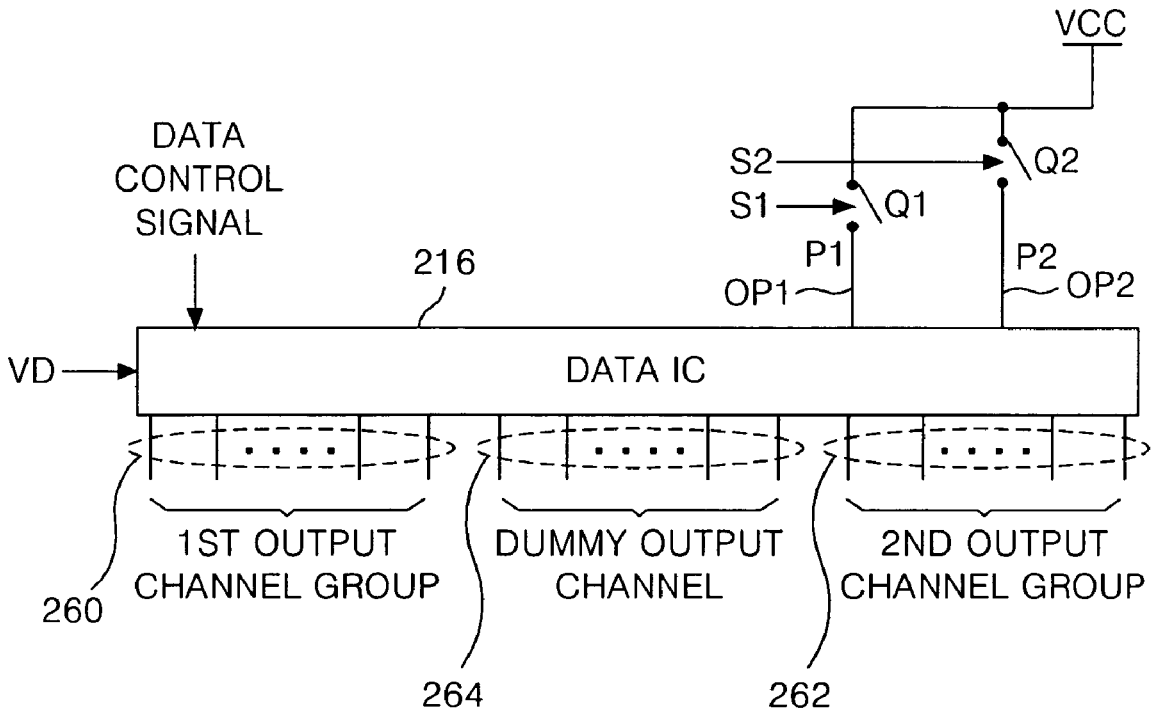
FIG. 15 illustrates switching devices for generating the first and second channel selection signals shown in FIG. 10.

In another embodiment, the first and second channel selection signals P1 and P2 applied to the first and second option pins OP1 and OP2 of the data IC's 116 and 216 of the first and second embodiments, respectively, of the present invention may be generated by a selective switching of first and second switches Q1 and Q2 as shown in FIG. 15.

The first switch Q1 is connected between the voltage source VCC and the first option pin OP1, while the second switch Q2 is connected between the voltage source VCC and the second option pin OP2. The first and second switches Q1 and Q2 are switched by switching signals S1 and S2 from the timing controller 108, respectively, or are switched by switching signals S1 and S2 set based upon a resolution type of the liquid crystal display panel 102, respectively.

Figure 16:
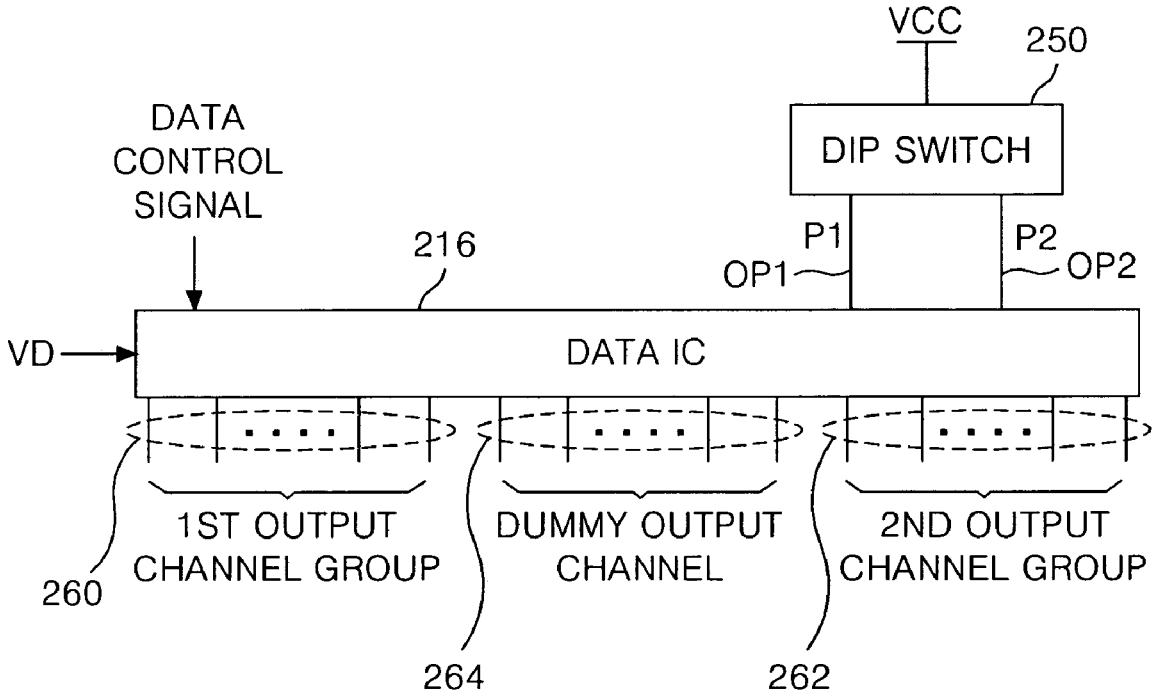
FIG. 16 illustrates a dip switch for generating the first and second channel selection signals shown in FIG. 10.

Otherwise, the first and second channel selection signals P1 and P2 applied to the first and second option pins OP1 and OP2 of the data IC's 116 and 216 according to the first and second embodiments of the present invention may also be generated by a switching operation of a dip switch 250 connected to the voltage source VCC and, at the same time, connected to the respective first and second option pins OP1 and OP2 as shown in FIG. 16.

The dip switch 250 may be pre-set by a system engineer based upon a resolution of the liquid crystal display panel 102, to generate the first and second channel selection signals and apply the signals to the first and second option pins OP1 and OP2, respectively.

Figure 17:
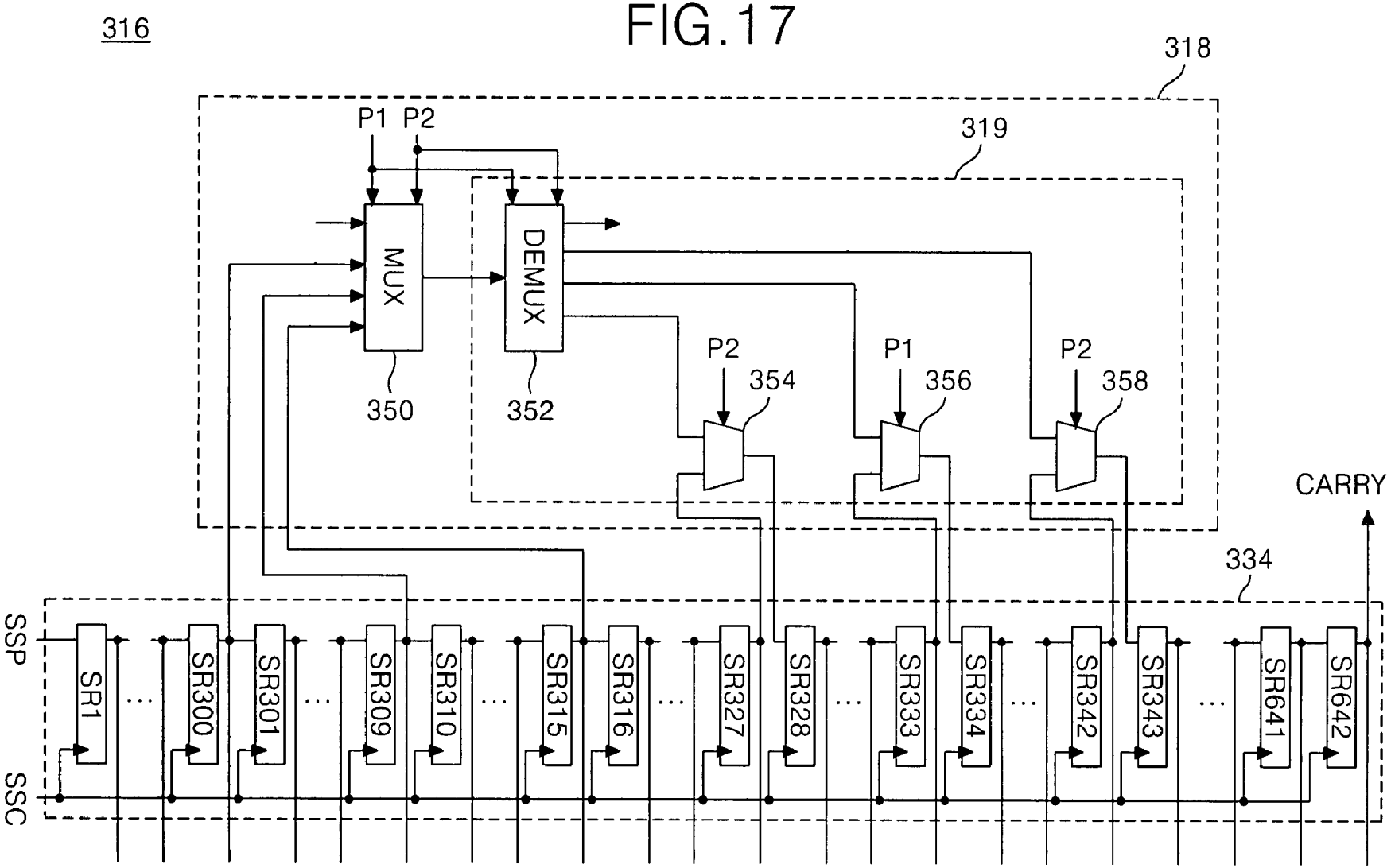
FIG. 17 is a block diagram showing a channel selector and a shift register part in a data integrated circuit according to a third embodiment of the present invention.

FIG. 17 is a block diagram showing a configuration of a data IC in a liquid crystal display according to a third embodiment of the present invention.

In FIG. 17, the LCD according to the third embodiment of the present invention has the same elements as the LCD according to the first embodiment of the present invention except for a data IC 316. Therefore, in the LCD according to the third embodiment of the present invention, the data IC 316 only will be described in conjunction with FIG. 17 and FIG. 4, and an explanation as to the other elements will be omitted. Herein, a reference numeral "116" of the data IC shown in FIG. 4 will be replaced by a reference numeral "316" shown in FIG. 17.

In the LCD according to the third embodiment of the present invention, the data IC 316 includes a first data output channel group 360 and a second data output channel group 362 for applying data to the data lines DL1 to DLm, and a dummy output channel group 364 provided between the first and second data output channel groups 360 and 362.

Such a data IC 316 further includes first and second option pins, for example, OP1 and OP2 supplied with first and second channel selection signals P1 and P2 for determining whether or not pixel data applied, via a dummy data output channel group 364, to the data lines DL1 to DLm in accordance with the number of the data lines DL1 to DLm is output.

Each of the first and second option pins OP1 and OP2 is selectively connected to a voltage source VCC and a ground voltage source GND to have a 2-bit binary logical value. Thus, the first and second channel selection signals P1 and P2 applied, via the first and second option pins OP1 and OP2, to the data IC 216 may have values of '00', '01', '10' and '11'.

Accordingly, each of the data IC's 316 has output channels set in advance based upon a resolution of the liquid crystal display panel 102 in response to the first and second channel selection signals P1 and P2 applied via the first and second option pins OP1 and OP2.

The number of data IC's 316 according to output channels of the data IC's 316 based upon a resolution-type of the liquid crystal display panel 102 is as indicated in the above Table 1.

Accordingly, the LCD according to the third embodiment of the present invention sets output channels of the data IC's 316, for example, to any one of 600 channels, 618 channels, 630 channels and 642 channels in response to the first and second channel selection signals P1 and P2, thereby configuring multiple resolution types of the liquid crystal display panel 102. In other words, the data IC 316 of the LCD according to the third embodiment of the present invention may have 642 data output channels. The output channels of the data IC's 316 are set in response to the first and second channel selection signals P1 and P2 from the first and second option pins OP1 and OP2, so that the LCD panel can be compatibly used for all resolution types of liquid crystal display panel 102. Further, the LCD according to the third embodiment of the present invention arranges the dummy data output channel group 364 of the data IC 316 at the middle portion of data output channels of the data IC 316. In other words, first and second data output channel groups 360 and 362 of the data IC 216 have the same number of output channels with having the dummy data output channel group 364 therebetween. Thus, the LCD according to the third embodiment of the present invention equalizes output channels of each of the first and second data output channel groups 360 and 362 of the data IC 316, thereby reducing an electro-magnetic interference upon output of the pixel data.

Specifically, the data IC 316 of the LCD according to the third embodiment of the present invention may be manufactured to have 642 data output channels.

When a value of the first and second channel selection signals P1 and P2 applied to the data IC 216 is '00', by connecting each of the first and second option pins OP1 and OP2 to the ground voltage source GND, the data IC 316 outputs pixel data via the first data output channel group 360 having the 1st to 300th output channels from the 642 data output channels and the second data output channel group 362 having the 343rd to 642nd output channels similar to FIG. 11. In this case, the dummy data output channel group 264 has the 301st to 342nd output channels and are treated as dummy lines.

When a value of the first and second channel selection signals P1 and P2 applied to the data IC 316 is '01' by connecting as the first option pin OP1 to the ground voltage source GND and the second option pin OP2 to the voltage source VCC, the data IC 316 outputs pixel data via the first data output channel group 360 having the 1st to 309th output channels from the 642 data output channels and the second data output channel group 262 having the 334th to 642nd output channels similar to FIG. 12. In this case, the dummy data output channel group 264 has the 310th to 333rd output channels and are treated as dummy lines.

Meanwhile, when a value of the first and second channel selection signals P1 and P2 applied to the data IC 316 is '10' by connecting the first option pin OP1 to the voltage source VCC and the second option pin OP2 to the ground voltage source GND, the data IC 316 outputs pixel data via the first data output channel group 360 having the 1st to 315th output channels of 642 data output channels and the second data output channel group 262 having the 328th to 642nd output channels similar to FIG. 13. In this case, the dummy data output channel group 264 has the 316th to 327th output channels and are treated as dummy lines.

Finally, when a value of the first and second channel selection signals P1 and P2 applied to the data IC 316 is '11' by connecting each of the first and second option pins OP1 and OP2 are connected to the voltage source VCC, the data IC 316 outputs pixel data via the first data output channel group 360, the dummy data output channel group 364 and the second output channel group 362, that is, via the 1st to 642nd data output channels similar to FIG. 14.

To this end, as shown in FIG. 17, the data IC 316 of the LCD according to the third embodiment of the present invention includes a channel selector 318 for setting an output channel of the data IC 316 in response to the first and second channel selection signals P1 and P2 applied to the first and second option pins OP1 and OP2, a shift register part 334 for applying sequential sampling signals, a latch part (not shown) for sequentially latching the pixel data VD in response to the sampling signals to simultaneously output them, a digital to analog converter (DAC) (not shown) for converting the pixel data VD from the latch part to pixel voltage signals, and an output buffer part (not shown) for buffering pixel voltage signals from the DAC.

The data IC 316 further includes a signal controller (not shown) for interfacing various control signals from the timing controller 108 and the pixel data VD, and a gamma voltage part (not shown) for supplying positive and negative gamma voltages required for the DAC.

Because a data IC 316 including the latch part, the DAC, the output buffer part, the signal controller and the gamma voltage part except for the channel selector 318 and the shift register part 334 are identical to the data IC 116 of the LCD according to the first embodiment of the present invention.

In the data IC 316 of the LCD according to the third embodiment of the present invention, the shift register part 334 of the data IC 216 is comprised of N shift registers SR1 to SRn. Shift registers included in the shift register part 334 sequentially shift a source start pulse SSP signal from the signal controller in response to a source sampling clock signal SSC to output the signals as sampling signals. An output signal, Carry, of the Nth shift register SRn of the shift register part 334 is applied to the 1st shift register SR1 of a next stage data IC 216. In this case, the shift register part 334 will be described assuming that it consists of 642 shift registers SR1 to SR642.

The channel selector 318 includes a first multiplexer 350 for selectively outputting one of an output signal of the I1th shift register SRI1 (wherein I1 is an integer larger than 1), an output signal of the I2nd shift register SRI2 (wherein I2 is an integer larger than I1) and an output signal of the I3th shift register SRI3 (wherein I3 is an integer larger than I2 and smaller than N) in response to the first and second channel selection signals P1 and P2; a demultiplexer 352 for applying the output signal of the first multiplexer 350 to one of the J1th shift register SRJ1 (wherein J1 is an integer larger than I3), the J2nd shift register SRJ2 (wherein J2 is an integer larger than J1) and the J3th shift register SRJ3 (wherein J3 is an integer larger than J2 and smaller than N) in response to the first and second channel selection signals P1 and P2; a second multiplexer 354 for applying one of the output signal of the (J1−1)th shift register SRJ1−1 and the output signal of the demultiplexer 352 to the J1th shift register SRJ1 in response to the second channel selection signal P2, a third multiplexer 356 for applying one of the output signal of the (J2−1)th shift register SRJ2−1 and the output signal of the demultiplexer 352 to the J2nd shift register SRJ2 in response to the first channel selection signal P1, and a fourth multiplexer 358 for applying any one of the (J3−1)th shift register SRJ3−1 and the demultiplexer 352 to the J3th shift register SRJ3 in response to the second channel selection signal P2. Hereinafter, I1 should be referred to as the 300th shift register SR300; I2 should be referred to as the 309th shift register SR309; and I3 should be referred to as the 315th shift register SR315. Further, J1 should be referred to as the 328th shift register SR328; J2 should be referred to as the 334th shift register SR334; and J3 should be referred to as the 343rd shift register SR343. Herein, the first multiplexer 350 becomes a first selector, and the demultiplexer 352 and the second to fourth multiplexers 354, 356 and 358 become a second selector 319.

The first multiplexer 350 selects an output signal of the 300th shift register SR300 when a logical value of the first and second channel selection signals P1 and P2 is "00", and applies it to the demultiplexer 352. The first multiplexer 350 selects an output signal of the 309th shift register SR309 when a logical value of the first and second channel selection signals P1 and P2 is "01", and applies it to the demultiplexer 352. The first multiplexer 350 selects an output signal of the 315th shift register SR315 when a logical value of the first and second channel selection signals P1 and P2 is "10", and applies it to the demultiplexer 352. When a logical value of the first and second channel selection signals P1 and P2 is "11", the first multiplexer 350 and demultiplexer 352 are not necessary.

The demultiplexer 352 applies an output signal of the first multiplexer 350 to the fourth multiplexer 358 when a logical value of the first and second selection signals P1 and P2 is "00". The demultiplexer 352 applies an output signal of the first multiplexer 350 to the third multiplexer 356 when a logical value of the first and second selection signals P1 and P2 is "01". The demultiplexer 352 applies an output signal of the first multiplexer 350 to the second multiplexer 354 when a logical value of the first and second selection signals P1 and P2 is "10". On the other hand, the demultiplexer 352 is not necessary when a logical value of the first and second selection signals P1 and P2 is "11".

The second multiplexer 354 applies an output signal of the demultiplexer 352 to the 328th shift register SR328 when a logical value of the second channel selection signal P2 is '0'.

The second multiplexer 354 applies an output signal of the 327th shift register SR327 to the 328th shift register SR328 when a logical value of the second channel selection signal P2 is '1'.

The third multiplexer 356 applies an output signal of the demultiplexer 352 to the 334th shift register SR334 when a logical value of the first channel selection signal P1 is '0'. The third multiplexer 356 applies an output signal of the 333rd shift register SR333 to the 334th shift register SR334 when a logical value of the first channel selection signal P1 is '1'.

The fourth multiplexer 358 applies an output signal of the demultiplexer 352 to the 343rd shift register SR343 when a logical value of the second channel selection signal P2 is '0'. The fourth multiplexer 358 applies an output signal of the 342nd shift register SR342 to the 343rd shift register SR343 when a logical value of the second channel selection signal P2 is '1'.

Operations of the channel selector 318 and the shift register part 334 according to the first and second channel selection signals P1 and P2 will be described below.

First, as shown in FIG. 11, when the 1st to 300th output channels, of the output channels of the data IC 216, are selected as a first output channel group 260, the 301st to 342nd output channels are selected as a dummy output channel group 264, and the 343rd to 642nd output channels are selected as a second output channel group 262. The channel selector 318 of the data IC 316 is supplied with the first and second channel selection signals P1 and P2 having a logical value of "00". Thus, the shift register part 334 sequentially shifts the source start pulse SSP signal in response to the source sampling clock signal SSC using the 1st to 600th shift registers SR1 to SR600 to thereby output them as sampling signals. At this time, an output signal of the 300th shift register SR300 is applied, via the first multiplexer 350, the demultiplexer 352 and the fourth multiplexer 358, to the 343rd shift register SR343. Further, an output signal of the 642nd shift register SR642 is applied to the 1st shift register SR1 of the next stage data IC 316. Thus, the 1st to 300th shift registers SR1 to SR300 and the 343rd to 642nd shift registers, SR343 and SR642, apply the sampling signals to the latch part. At this time, the 301st to 342nd shift registers SR301 to SR342 also substantially apply the sampling signals to the latch part.

Next, as shown in FIG. 12, when the 1st to 309th output channels of the output channels of the data IC 216 are selected as a first output channel group 260; the 310th to 333rd output channels are selected as a dummy output channel group 264; and the 334th to 642nd output channels are selected as a second output channel group 262, the channel selector 318 of the data IC 316 is supplied with the first and second channel selection signals P1 and P2 having a logical value of "01". Thus, the shift register part 334 sequentially shifts the source start pulse SSP signal in response to the source sampling clock signal SSC using the 1st to 600th shift registers SR1 to SR600 to thereby output them as sampling signals. At this time, an output signal of the 309th shift register SR309 is applied, via the first multiplexer 350, the demultiplexer 352 and the third multiplexer 356, to the 334th shift register SR334. Further, an output signal of the 642nd shift register, SR642, is applied to the 1st shift register SR1 of the next stage data IC 316. Thus, the 1st to 309th shift registers, SR1 to SR309, and the 334th to 642nd shift registers, SR334 and SR642, apply the sampling signals to the latch part. At this time, the 310th to 333rd shift registers SR310 to SR333 also substantially apply the sampling signals to the latch part.

Subsequently, as shown in FIG. 13, when the 1st to 315th output channels of the output channels of the data IC 216 are selected as a first output channel group 260, the 316th to 327th output channels are selected as a dummy output channel group 264, and the 328th to 642nd output channels are selected as a second output channel group 262. The channel selector 318 of the data IC 316 is supplied with the first and second channel selection signals P1 and P2 having a logical value of "10". Thus, the shift register part 334 sequentially shifts the source start pulse SSP signal in response to the source sampling clock signal SSC using the 1st to 600th shift registers SR1 to SR600 to thereby output them as sampling signals. At this time, an output signal, of the 315th shift register SR315 is applied, via the first multiplexer 350, the demultiplexer 352 and the second multiplexer 354, to the 328th shift register SR328. Further, an output signal, Carry, of the 642nd shift register, SR642, is applied to the 1st shift register SR1 of the next stage data IC 316. Thus, the 1st to 315th shift registers, SR1 to SR315, and the 328th to 642nd shift registers, SR328 and SR642, apply the sampling signals to the latch part. The 316th to 327th shift registers, SR310 to SR327, also substantially apply the sampling signals to the latch part.

Consequently, as shown in FIG. 14, when the 1st to 321st output channels of the output channels of the data IC 216 are selected as a first output channel group 260, and the 322nd to 642nd output channels are selected as a second output channel group 262, the channel selector 318 of the data IC 316 is supplied with the first and second channel selection signals P1 and P2 having a logical value of "11". Thus, the shift register part 334 sequentially shifts the source start pulse SSP signal in response to the source sampling clock signal SSC using the 1st to 642nd shift registers SR1 to SR642 to thereby output them as sampling signals. The first multiplexer 350 and the demultiplexer 352 are not necessary when the logical value is "11." Further, an output signal of the 327th shift register SR327 is applied, via the second multiplexer 352, to the 328th shift register SR328; an output signal of the 333rd shift register SR333 is applied, via the third multiplexer 356, to the 334th shift register SR334; and an output signal of the 342nd shift register SR342 is applied, via the fourth multiplexer 358, to the 343rd shift register SR342. Thus, each of the 1st to 642nd shift registers SR1 to SR642 of the shift register part 334 applies the sampling signal to the latch part. Herein, an output signal of the 642nd shift register SR642 is applied to the 1st shift register SR1 of the next stage data IC 216.

Such a data IC 316 of the LCD according to the third embodiment of the present invention converts data VD from the timing controller 108 to pixel data using the sampling signals output from the shift register part 334 in accordance with an operation of the data IC 116 of the LCD according to the first embodiment of the present invention to thereby apply them, via a portion of the first and second output channel groups 260 and 262 and the dummy output channel group 264, to the data lines DL of the liquid crystal display panel 102.

As described above, the LCD according to the third embodiment of the present invention sets the output channels of the data IC 316 in accordance with a desired resolution of the liquid crystal display panel 102 as indicated in the above Table 1 in response to the first and second channel selection signals P1 and P2 applied to the first and second option pins OP1 and OP2, thereby configuring multiple resolution types using only one data IC 316. Accordingly, the LCD according to the third embodiment of the present invention improves working efficiency as well as reduces manufacturing cost.

Alternatively, in the LCD according to the third embodiment of the present invention, the first and second channel selection signals P1 and P2 applied to the first and second option pins OP1 and OP2 of the data IC 316 may be generated by selectively switching first and second switches Q1 and Q2 as shown in FIG. 15. An explanation as to the first and second switches Q1 and Q2 is identical to the above-mentioned description of the LCD according to the second embodiment of the present invention.

Otherwise, in the LCD according to the third embodiment of the present invention, the first and second channel selection signals P1 and P2 applied to the first and second option pins OP1 and OP2 of the data IC 316 may be generated by a switching operation of a dip switch 250 connected to the voltage source VCC and, at the same time, connected to the respective first and second option pins OP1 and OP2 as shown in FIG. 16. An explanation as to the dip switch 250 is identical to the above-mentioned description of the LCD according to the second embodiment of the present invention.

The LCD according to the first to third embodiments of the present invention as described above is not limited to only varying output channels of the data IC's 116, 216 and 316, each having 642 data output channels in response to the first and second channel selection signals P1 and P2, but is applicable to the data IC's 116, 216 and 316 having 642 output channels or less and 642 output channels or more.

Furthermore, the output channels of the data IC's 116, 216 and 316 set in response to the first and second channel selection signals P1 and P2 is not limited to only 600, 618, 630 and 642 data output channels, but may be applicable to other cases. In other words, the output channels of the data IC's 116, 216 and 316 set in response to the first and second channel selection signals P1 and P2 are determined based upon at least one condition of a resolution type of the liquid crystal display panel 102, the number of data TCP's, a width of the data TCP and the number of data transmission lines between the timing controller 108 and the data IC's 116, 216 and 316 for applying the pixel data from the timing controller 108 to the data IC's 116, 216 and 316. Accordingly, the number of output channels of the data IC's 116, 216 and 316 set in response to the first and second channel selection signals P1 and P2 may be 600, 618, 624, 630, 642, 645, 684, 696, 702 or 720, etc.

Moreover, the channel selection signals P1 and P2 for setting the output channels of the data IC's 116, 216 and 316 also are not limited to a 2-bit binary logical value, but may be a binary logical value having two or more bits.

The data IC's of the LCD according to the first to third embodiments of the present invention may be used for a flat panel display device including the above-mentioned LCD.

As described above, the LCD according to the present invention varies channels of the data integrated circuit in accordance with a resolution type of the liquid crystal display panel using the channel selection signals, thereby configuring multiple resolution types of the liquid crystal display panel.

Furthermore, the LCD according to the present invention includes the data integrated circuit having the dummy data output channel group provided between the first and second data output channel groups for applying data to the data lines, and varies channels of the data integrated circuit based upon a resolution type of the liquid crystal display panel using the channel selection signals, thereby driving all resolutions of the liquid crystal display panel using one type of data integrated circuit.

Accordingly, the LCD according to the present invention can compatibly use the data integrated circuit independently of a resolution type of the liquid crystal display panel, so that the number of data integrated circuits can be reduced. As a result, the LCD according to the present invention improves working efficiency as well as reduces manufacturing cost.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display having a data driving integrated circuit, comprising:

N number of output channels where N is an integer including a first output channel and an Nth output channel, the data output channels selectable to output video data;

a data output channel group having at least two regions and including M number data output channels of the N number of output channels (where M is an integer less than N), the M data output channels supplying pixel data to a corresponding number of data lines in accordance with a desired resolution of the display, wherein (N-M) output channels of the N output channels are not supplied with pixel data;

a shift register part including a sequence of N shift registers for shifting the pixel data, wherein the Mth shift register outputs a carry signal to a carry bit output terminal of the data driving integrated circuit; and a channel selector having at least two selection signals for selecting the M number for the M data output channels and for the Mth shift register that outputs the carry signal to the carry bit output terminal, wherein the at least two selection signals are integer values that are distinct from the each other.

2. The display according to claim 1, wherein the M number of data output channels is programmable.

3. The display according to claim 1, further comprising:

a selection signal generator for generating and applying a channel selection signal to select the M data output channels; and a timing controller controlling the data driving integrated circuit and supplying the pixel data to the M data output channels.

4. The display according to claim 3, wherein the selection signal generator includes first and second selection terminals, each of the first and second selection terminals being connected to one of a first voltage source and a second voltage source to generate and supply the channel selection signal.

5. The display according to claim 3, wherein the

N shift registers generating a sampling signal for shifting the pixel data in response to a control signal from the timing controller, wherein N is an integer, and wherein the data driving integrated circuit further comprises:

a latch unit for latching pixel data in response to the sampling signals from the N shift registers;

a digital-to-analog converter for converting the pixel data from the latch unit to analog pixel data; and a buffering output portion for buffering the pixel data from the digital-to-analog converter to supply the pixel data to the data lines corresponding to the M data output channels.

6. The display according to claim 4, wherein the first and second selection terminals generate first and second logical values to determine the M data output channels such that:

when the logical value is the second logical value, I data output channels are selected, wherein I is a positive integer smaller than N; and when the logical value is the first logical value, J data output channels are selected, wherein J is a positive integer smaller than I.

7. The display according to claim 4, wherein the first and second selection terminals generate first to fourth logical values to determine the M data output channels such that:

when the logical value is the fourth logical value, I data output channels are selected, wherein I is a positive integer smaller than N;

when the logical value is the third logical value, J data output channels are selected, wherein J is a positive integer smaller than I;

when the logical value is the second logical value, K data output channels are selected, wherein K is a positive integer smaller than J; and when the logical value is the first logical value, L data output channels are selected, wherein L is a positive integer smaller than K.

8. The display according to claim 7, wherein the data output channel group includes any one of the first output channel to the Ith data output channel, the first output channel to the Jth data output channel, the first output channel to the Kth data output channel, and the first output channel to the Lth data output channel.

9. The display according to claim 3, wherein the selection signal generator generates the channel selection signal based upon at least one of the number of data lines, the number of data driving integrated circuits corresponding to a desired resolution of the display, a width of a tape carrier package mounted with the data driving integrated circuit, and a number of data transmission lines between the timing controller and the data driving integrated circuit.

10. The display according to claim 4, wherein the selection signal generator includes a switching device connected to the selection terminals.

11. The display according to claim 4, wherein the selection signal generator includes a dip switch connected to the selection terminals.

12. The display according to claim 1, wherein the (N-M) data output channels are dummy channels.

13. The display according to claim 12, wherein the dummy channels are floated.

14. The display according to claim 12, wherein the dummy channels are set to a constant voltage.

15. The display according to claim 1, wherein the (N-M) output channels are located between the at least two regions of the data output channel group.

16. The display according to claim 1, wherein the at least two regions of the data output channel group have the same number of data output channels.

17. A programmable data driving integrated circuit connected to a plurality of data lines of a display, comprising:

N number of output channels where N is an integer including a first output channel and an Nth output channel;

a data output channel group having at least two regions including M number of the N number data output channels (where M is an integer less than N), the M data output channels supplying pixel data to a corresponding number of the data lines in accordance with a desired resolution of the display, wherein (N-M) of the N number output channels are not supplied with pixel data, and the output channels are located between the first output channel and the Nth output channel;

a shift register part including a sequence of N shift registers for shifting the pixel data, wherein the Mth shift register outputs a carry signal to a carry bit output terminal of the data driving integrated circuit; and a channel selector having at least two selection signals for selecting the M number for the M data output channels and for the Mth shift register that outputs the carry signal to the carry bit output terminal, wherein the at least two selection signals are integer values that are distinct from the each other.

18. The programmable data driving integrated circuit according to claim 17, further comprising:

a selection signal generator for generating a channel selection signal to select the M number of data output channels.

19. The programmable data driving integrated circuit according to claim 18, wherein the channel selector varies the M number of data output channels within the data output channel group in accordance with the channel selection signal.

20. The programmable data driving integrated circuit according to claim 18, wherein the selection signal generator generates said channel selection signal based upon at least one of the number of said data lines, the number of said programmable data integrated circuits, a width of the tape carrier package mounted with said programmable data driving integrated circuit, and the number of input lines of the pixel data.

21. The programmable data driving integrated circuit according to claim 18, wherein the channel selector generates first and second logical values such that:

when the logical value is the second logical value, I data output channels are selected, wherein I is a positive integer smaller than N; and when the logical value is the first logical value, J data output channels are selected, wherein J is a positive integer smaller than I.

22. The programmable data driving integrated circuit according to claim 18, wherein the channel selector generates first to fourth logical values such that:

when the logical value is the fourth logical value, I data output channels are selected, wherein I is a positive integer smaller than N;

when the logical value is the third logical value, J data output channels are selected, wherein J is a positive integer smaller than I;

when the logical value is the second logical value, K data output channels are selected, wherein K is a positive integer smaller than J; and when the logical value is the first logical value, L data output channels are selected, wherein L is a positive integer smaller than K.

23. The programmable data driving integrated circuit according to claim 22, wherein the data output channel group includes any one of the first output channel to the Ith data output channel, the first output channel to the Jth data output channel, the first output channel to the Kth data output channel, and the first output channel to the Lth data output channel.

24. The programmable data driving integrated circuit according to claim 17, wherein the (N-M) output channels are located between the at the least two regions of the data output channel group.

25. The programmable data driving integrated circuit according to claim 17, wherein the at least two regions of the data output channel group have the same number of data output channels.

26. The programmable data driving integrated circuit according to claim 17, wherein the (N-M) output channels are floated.

27. The programmable data driving integrated circuit according to claim 17, wherein the (N-M) output channels are set to a constant voltage.

28. The programmable data driving integrated circuit according to claim 18, wherein the selection signal generator includes first and second selection terminals respectively connected to a first voltage source and a second voltage source to generate the channel selection signal.

29. The programmable data driving integrated circuit according to claim 18, wherein the selection signal generator includes a switch for generating the channel selection signal.

30. The programmable data driving integrated circuit according to claim 18, wherein the selection signal generator includes a dip switch for generating the channel selection signal.

31. The programmable data driving integrated circuit according to claim 17, wherein the N shift registers generating a sampling signal for shifting the pixel data in response to a control signal, wherein N is an integer, further comprising:

a latch unit for latching pixel data in response to the sampling signals from the N shift registers;

a digital-to-analog converter for converting the pixel data from the latch unit to analog pixel data; and a buffering output unit for buffering the pixel data from the digital to analog converter to supply the pixel data fro the data lines corresponding to the M data output channels.

32. A data driving integrated circuit comprising:

N output channels (where N is an integer) including first, second and third output channel groups, the second output channel group being dummy output channels which are not supplied with pixel data;

a channel selector for selecting output channels of the N output channels for the first and third output channel groups corresponding to a plurality of data lines of a display having a desired resolution to supply pixel data and for assigning the remaining output channels to the second output channel group ;and N shift registers generating a sampling signal for shifting the pixel data;

wherein the second output channel group is located between the first and third output channel groups, wherein the channel selector selects the first and third channels to have a total of M number of the N output channels, and wherein the channel selector configures the N shift registers to shift the pixel data M times and outputs the M shifted pixel data as carry data.

33. The data driving integrated circuit according to claim 32, wherein the second output channel group includes the number N/2 output channel of the number 1-Nth output channels.

34. The data driving integrated circuit according to claim 32, further comprising a selection signal generator generating a channel selection signal for selecting the output channels.

35. The data driving integrated circuit according to claim 32, wherein the N shift registers generating a sampling signal for shifting the pixel data, wherein N is an integer, and further comprising:

a latch unit for latching the pixel data in response to the sampling signal;

a digital-to-analog converter for converting the pixel data from the latch unit to analog pixel data; and buffer output unit for buffering the pixel data from the digital to analog converter to supply the pixel data to said plurality of data lines corresponding to the first and third output channel groups.

36. The data driving integrated circuit according to claim 34, wherein the selection signal generator generates said channel selection signal based on at least one of the number of said data lines, the number of said data integrated circuits corresponding to a desired resolution of the display, a width of a tape carrier package mounted with said data driving integrated circuit, and the number of input lines of the pixel data.

37. The data driving integrated circuit according to claim 34, wherein the selection signal generator includes first and second selection terminals respectively connected to a first voltage source and a second voltage source to generate the channel selection signal.

38. The data driving integrated circuit according to claim 32, wherein the first and the second data output channel groups have the same number of output channels.

39. The data driving integrated circuit according to claim 32, wherein the first output channel group includes a first output channel of the N output channels to one of I1th, I2th and I3th output channels of the N output channels, wherein I1 is an integer larger than 1,I2 is an integer larger than I1, and I3 is an integer larger than I2 and smaller than N (where N is the total number of output channels).

40. The data driving integrated circuit according to claim 39, wherein the second data output channel group includes one of J1th, J2nd and J3th output channels to the Nth output channel, wherein J1 is an integer larger than I3, J2 is an integer larger than J1, J3 is an integer larger than J2 and smaller than N.

41. The data driving integrated circuit according to claim 40, wherein any one of the (I1+1)th to (J3−1)th, the (I2+1)th to (J2−1)th and the (I3+1)th to (J1−1)th output channels is a dummy output channel group.

42. The data driving integrated circuit according to claim 41, wherein the dummy output channel group is floated.

43. The data driving integrated circuit according to claim 34, wherein the dummy output channel group is set to a constant voltage.

44. The data driving integrated circuit according to claim 34, wherein said selection signal generator includes a switch for generating the channel selection signal.

45. The data driving integrated circuit according to claim 34, wherein said selection signal generator includes a dip switch for generating the channel selection signal.

46. The data driving integrated circuit according to claim 32, wherein the number of output channels is programmable.

47. A programmable data driving integrated circuit including a shift register portion having N shift registers (where N is a positive integer) shifting a start pulse to a sequential sampling signal, comprising:

an output channel unit including first and second output channel groups;

a first selector for selecting an output signal from a first shift register group of the N shift registers corresponding to the first output channel group and selecting a first data output channel group connected to a first number of data lines in the first output channel group; and a second selector for supplying the output signal from the first selector to a second shift register group corresponding to the second output channel group and selecting a second data output channel group connected to a second number of data lines in the second output channel group, wherein the first selector includes a first multiplexer selecting in response to said channel selection signal one of output signals of the I1st shift register of the N shift registers, wherein I1 is a positive integer larger than 1, the I2nd shift register of the N shift register, wherein I2 is a positive integer larger than I1, and the I3rd shift register of the N shift registers, wherein I3 is a positive integer larger than I2 and smaller than N.

48. The programmable data driving integrated circuit according to claim 47, further comprising a selection signal generator generating a channel selection signal for selecting the first and second data output channel groups.

49. The programmable data driving integrated circuit according to claim 48, wherein the selection signal generator generates said channel selection signal based upon at least one of the number of said data lines, the number of said programmable data driving integrated circuits, a width of a tape carrier package mounted with said programmable data driving integrated circuit, and the number of input lines of the pixel data.

50. A programmable data driving integrated circuit including a shift register portion having N shift registers (where N is a positive integer) shifting a start pulse to a sequential sampling signal, comprising:

an output channel unit including first and second output channel groups;

a first selector for selecting an output signal from a first shift register group of the N shift registers corresponding to the first output channel group and selecting a first data output channel group connected to a first number of data lines in the first output channel group; and a second selector for supplying the output signal from the first selector to a second shift register group corresponding to the second output channel group and selecting a second data output channel group connected to a second number of data lines in the second output channel group a selection signal generator generating a channel selection signal for selecting the first and second data output channel groups, wherein the selection signal generator includes a selection terminal connected to a first voltage source and a second voltage source to generate the channel selection signal.

51. The programmable data driving integrated circuit according to claim 48, wherein the selection signal generator includes a selective switch for generating the channel selection signal.

52. The programmable data driving integrated circuit according to claim 48, wherein the selection signal generator includes a dip switch generating the channel selection signal.

53. The programmable data driving integrated circuit according to claim 47, wherein the first and the second output channel groups have a same number of output channels.

54. The programmable data driving integrated circuit according to claim 47, wherein the second selector includes:

a demultiplexer for generating an output signal from the first multiplexer in response to the channel selection signal;

a second multiplexer for selecting one of the output signals of the demultiplexer and an output signal of the (J1−1)th shift register of the N shift registers in response to the channel selection signal to apply the signals to the J1th shift register, wherein J1 is a positive integer larger than I3;

a third multiplexer for selecting one of the output signals of the demultiplexer and an output signal of the (J2−1)th shift register of the N shift registers in response to the channel selection signal to apply the signals to the J2nd shift register, wherein J2 is a positive integer larger than J1; and a fourth multiplexer for selecting one of the output signals of the demultiplexer and an output signal of the (J3−1)th shift register of the N shift registers in response to the channel selection signal to apply the signals to the J3rd shift register, wherein J3 is a positive integer larger than J3 and smaller than N.

55. The programmable data driving integrated circuit according to claim 54, wherein the channel selector selects one of the first to I1st data output channels (where I1 is an integer larger than 1), the first to I2nd data output channels (where I2 is an integer larger than I1), and the first to I3rd data output channels in the first data output channel group (where I3 is an integer larger than I2 and smaller than N) as the first data output channel group.

56. The programmable data driving integrated circuit according to claim 55, wherein said channel selector selects in response to the channel selection signal one of J1st to Nth data output channels (where J1 is a positive integer larger than I3), J2nd to Nth data output channels (where J2 is a positive integer larger than J1), and J3rd to Nth data output channels (where J3 is a positive integer larger than J2 and smaller than N) in the output channel group as the second data output channel group.

57. The programmable data driving integrated circuit according to claim 56, wherein any one of the (I1+1)th to (J3−1)th, the (I2+1)th to (J2−1)th and the (I3+1)th to (J1−1)th output channels are dummy output channels.

58. The programmable data driving integrated circuit according to claim 57, wherein the dummy output channels are set to a constant voltage.

59. The programmable data driving integrated circuit according to claim 57, wherein the dummy output channels are floated.

60. A method of driving a programmable data driving integrated circuit in a display, comprising:

determining a desired resolution of the display;

determining N number of output channels (where N is a positive integer) including a first output channel and an Nth output channel;

selecting a data output channel group having at least two regions and including M data output channels of the N output channels;

supplying pixel data from the M data output channels to a corresponding number of data lines in accordance with the desired resolution of the display; wherein (N-M) output channels of the N output channels are not supplied with pixel data, and the (N-M) output channels are located between the first output channel and the Nth output channel; and configuring a sequence of N shift registers to shift pixel data M times and outputting the M shifted pixel data as a carry output.

* * * * *